US012667163B2

(12) United States Patent
Choi et al.

(10) Patent No.: US 12,667,163 B2
(45) Date of Patent: Jun. 30, 2026

(54) SOLE STRUCTURE FOR AN ARTICLE OF FOOTWEAR

(71) Applicant: NIKE, Inc., Beaverton, OR (US)

(72) Inventors: Yoon Jeong Choi, Portland, OR (US); Jeremy L. Connell, Portland, OR (US); Craig Fredrick, Portland, OR (US); Lai Wa C. Ho, Beaverton, OR (US); Jason R. Meeker, Portland, OR (US); Ricardo Salinas, Jr., Hillsboro, OR (US); Chris Wilburn, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 17 days.

(21) Appl. No.: 18/999,500

(22) Filed: Dec. 23, 2024

(65) Prior Publication Data

US 2025/0212994 A1 Jul. 3, 2025

Related U.S. Application Data

(60) Provisional application No. 63/616,543, filed on Dec. 30, 2023.

(51) Int. Cl.

| | |
|---|---|
| ***A43B 13/18*** | (2006.01) |
| ***A43B 13/12*** | (2006.01) |
| ***A43B 13/20*** | (2006.01) |

(52) U.S. Cl.

CPC ..... *A43B 13/186* (2013.01); *A43B 13/122* (2013.01); *A43B 13/20* (2013.01)

(58) Field of Classification Search

CPC ..... A43B 13/20; A43B 13/122; A43B 13/186
See application file for complete search history.

(56) References Cited

U.S. PATENT DOCUMENTS

| | | | | |
|---|---|---|---|---|
| 5,625,964 | A * | 5/1997 | Lyden | A43B 13/20 36/114 |
| 9,687,044 | B2 * | 6/2017 | Schindler | A43B 13/206 |
| 10,070,690 | B2 * | 9/2018 | Cortez | A43B 13/127 |
| 12,171,300 | B2 * | 12/2024 | Bailly | A43B 13/186 |
| 2004/0123495 | A1 | 7/2004 | Greene et al. | |

(Continued)

FOREIGN PATENT DOCUMENTS

EP 3171725 B1 5/2020

OTHER PUBLICATIONS

European Patent Office (ISA), International Search Report and Written Opinion for PCT App. No. PCT/US2024/061868, mailed Mar. 17, 2025.

*Primary Examiner* — Haley A Smith
(74) *Attorney, Agent, or Firm* — Honigman LLP; Matthew H. Szalach

(57) ABSTRACT

A sole structure for an article of footwear, the sole structure including a cushioning member that includes a recessed portion and a projection. The sole structure also includes an outsole coupled to the cushioning member and including a protrusion. The sole structure further includes a bladder disposed between the cushioning member and the outsole. The bladder includes a first segment and a second segment and defines a notch between the first segment and the second segment. The notch extends from a first edge of the bladder in a direction toward a second edge of the bladder. The projection of the cushioning member and the protrusion of the outsole are at least partially disposed within the notch of the bladder.

18 Claims, 16 Drawing Sheets

(56) References Cited

U.S. PATENT DOCUMENTS

| | | | | |
|---|---|---|---|---|
| 2016/0021974 | A1* | 1/2016 | Schindler | A43B 13/223 12/146 B |
| 2016/0120263 | A1* | 5/2016 | Cortez | A43B 13/20 36/29 |
| 2020/0305549 | A1* | 10/2020 | Bailly | A43B 13/125 |
| 2021/0289884 | A1 | 9/2021 | Hurd et al. | |
| 2023/0404210 | A1* | 12/2023 | Connell | A43B 13/141 |

* cited by examiner

SOLE STRUCTURE FOR AN ARTICLE OF FOOTWEAR

CROSS REFERENCE TO RELATED APPLICATIONS

This application claims priority under 35 U.S.C. § 119(e) to U.S. Provisional Application No. 63/616,543, filed on Dec. 30, 2023. The disclosure of this prior application is considered part of the disclosure of this application and is hereby incorporated by reference in its entirety.

FIELD

The present disclosure relates generally to a sole structure and, more particularly, to a sole structure for an article of footwear.

BACKGROUND

This section provides background information related to the present disclosure and is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. For example, a sole structure may include a midsole and an outsole. The midsole is generally disposed between the outsole and the upper and provides cushioning for the foot. The midsole may include a pressurized fluid-filled chamber that compresses resiliently under an applied load to cushion the foot by attenuating ground-reaction forces. The outsole provides abrasion-resistance and traction with the ground surface and may be formed from rubber or other materials that impart durability and wear-resistance, as well as enhance traction with the ground surface.

While conventional sole structures provide a wearer with a degree of comfort and support during use, a continuous need exists to develop sole structures that provide targeted support and response for particular movements and activities.

DRAWINGS

The drawings described herein are for illustrative purposes only of selected configurations and not all possible implementations, and are not intended to limit the scope of the present disclosure.

Figure 1:
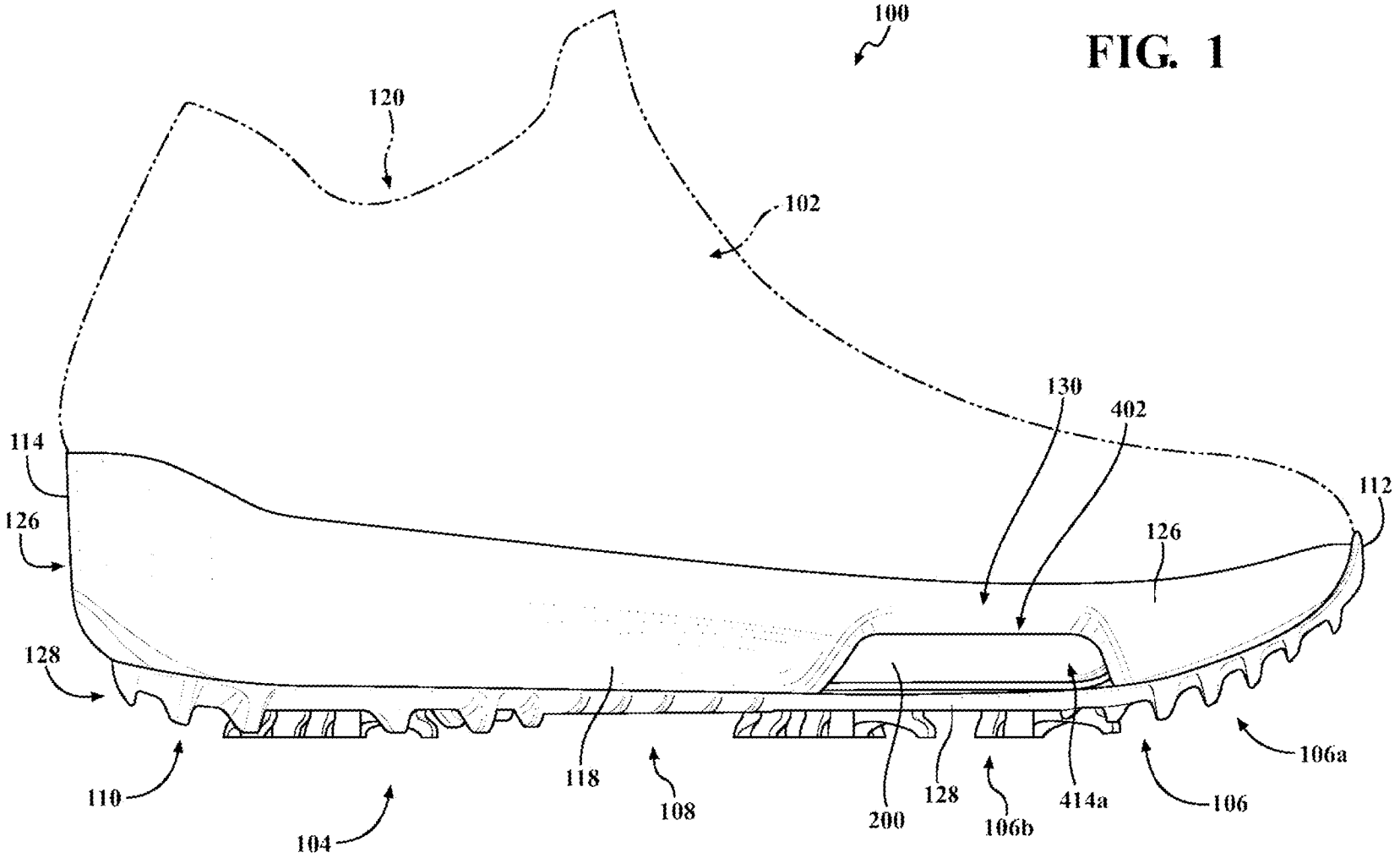
FIG. 1 is a medial side view of an article of footwear incorporating a sole structure in accordance with principles of the present disclosure.
Figure 6:
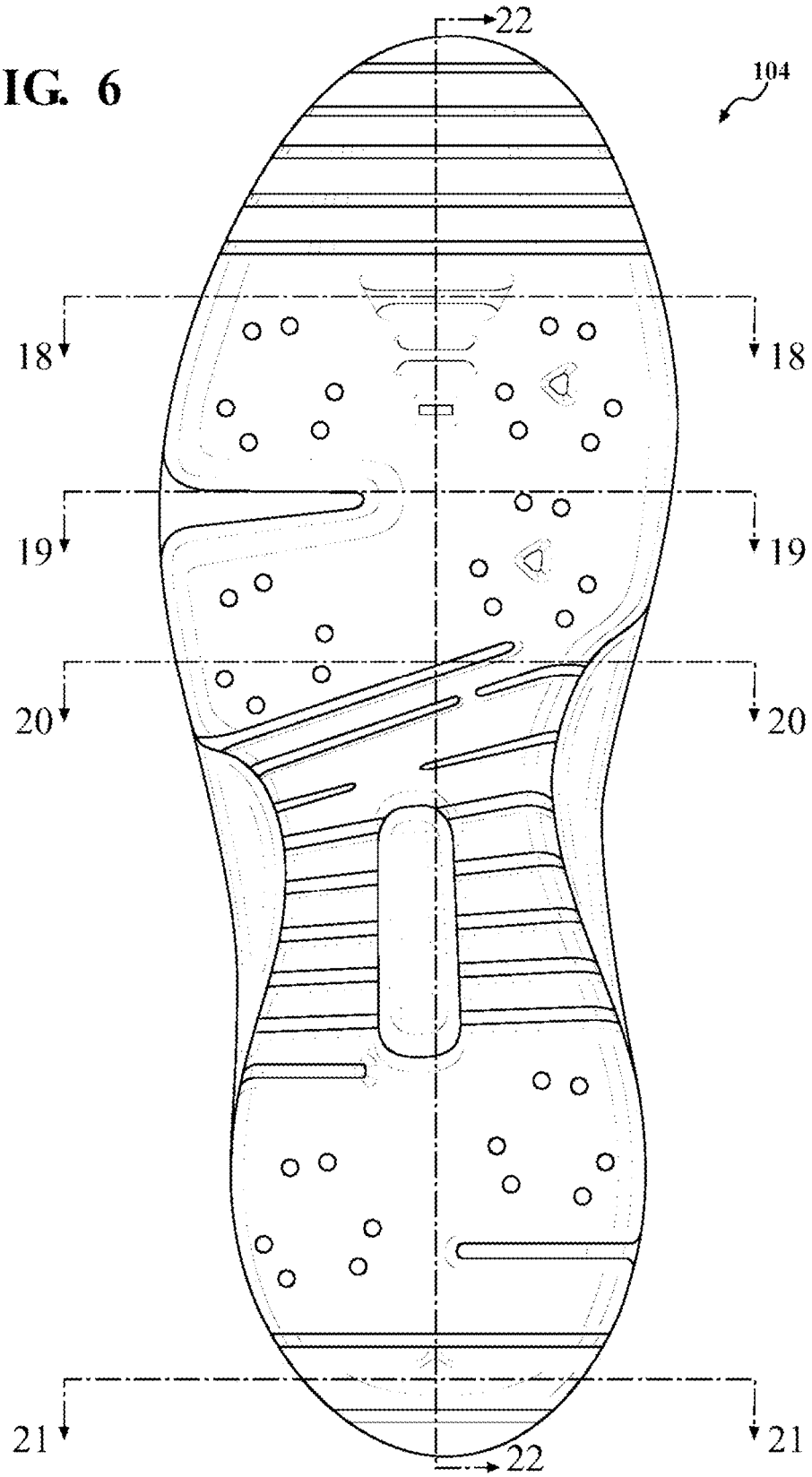
FIG. 6 is a bottom view of the sole structure of FIG. 1.
Figure 7:
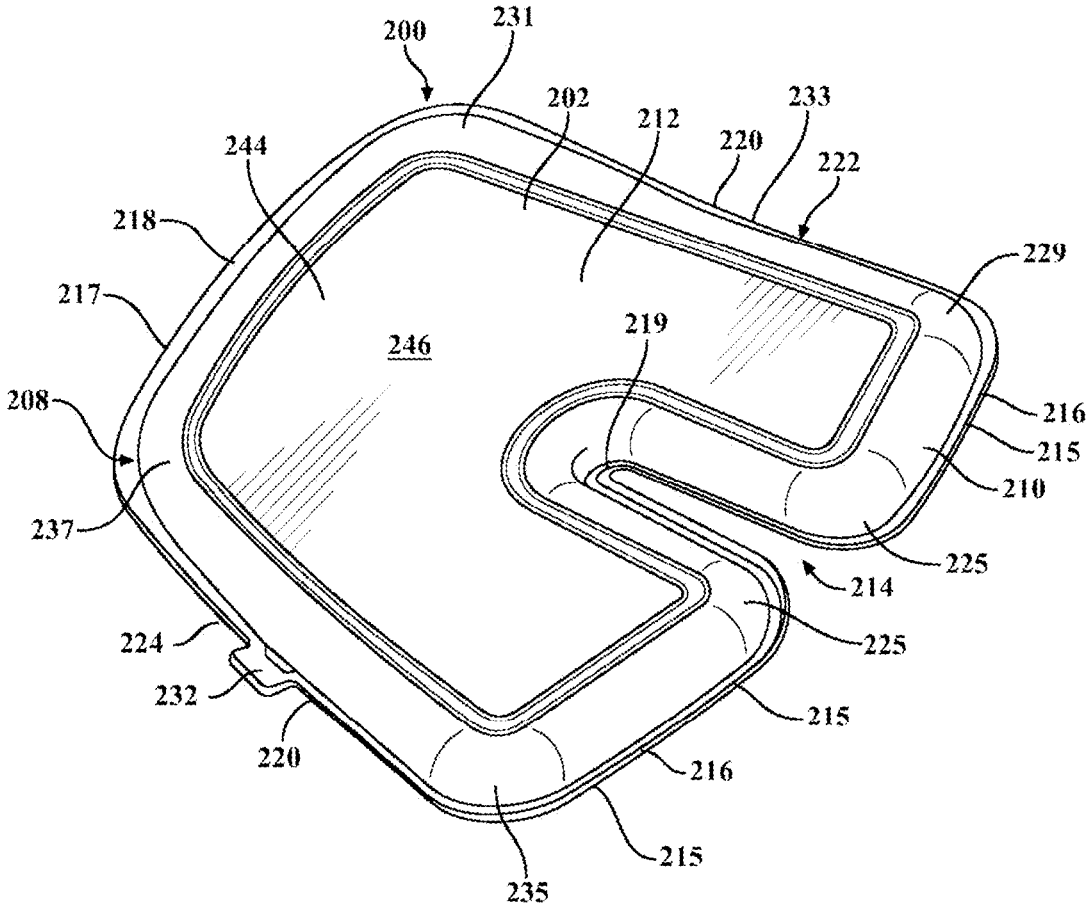
Figure 8:
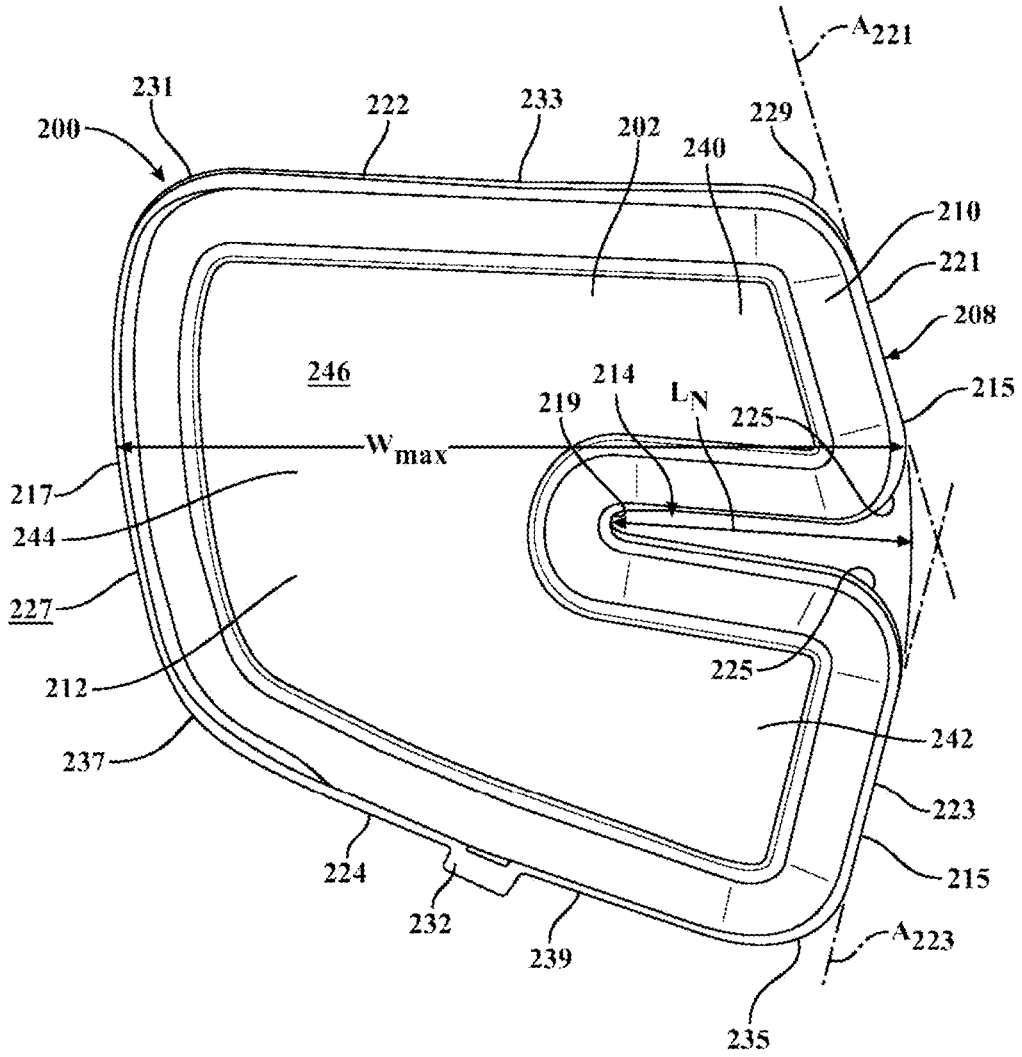
Figure 9:
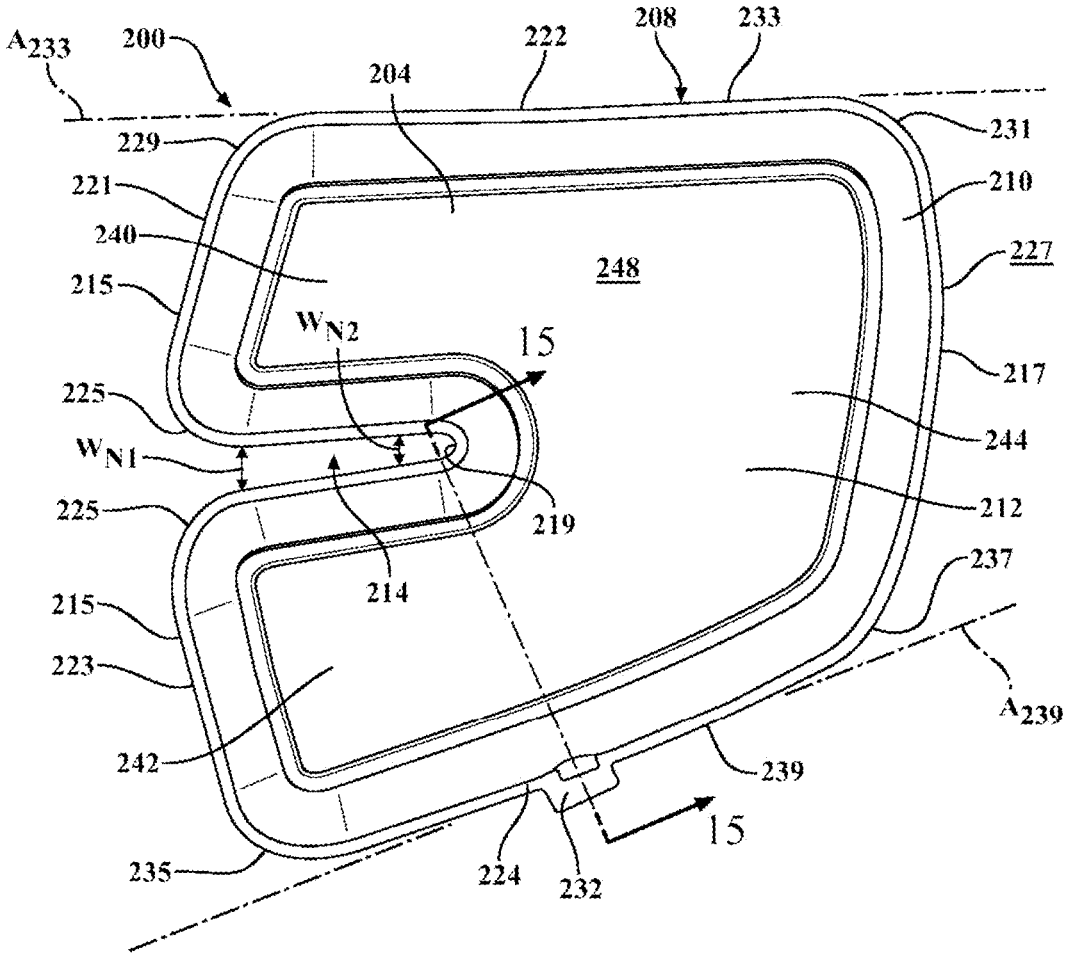
Figure 10:
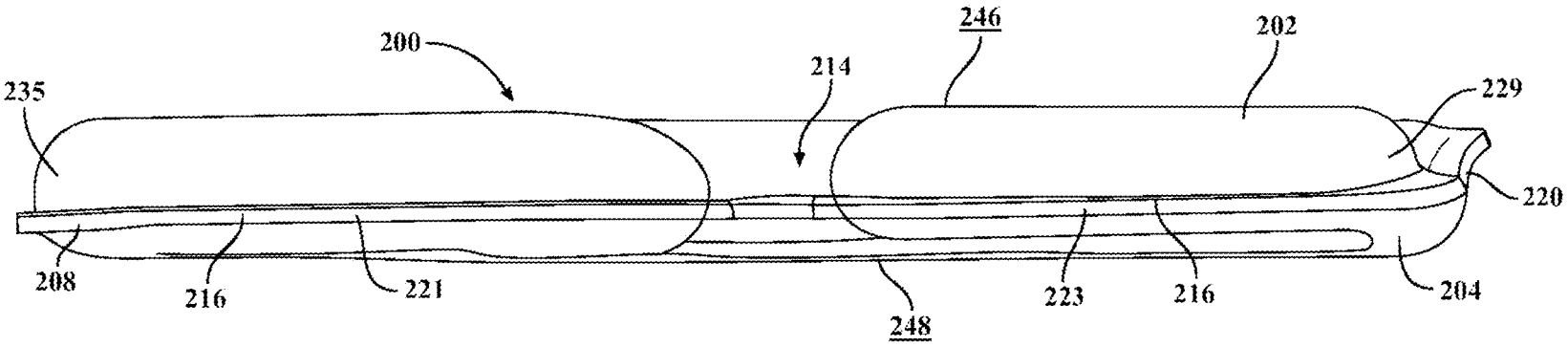
Figure 11:
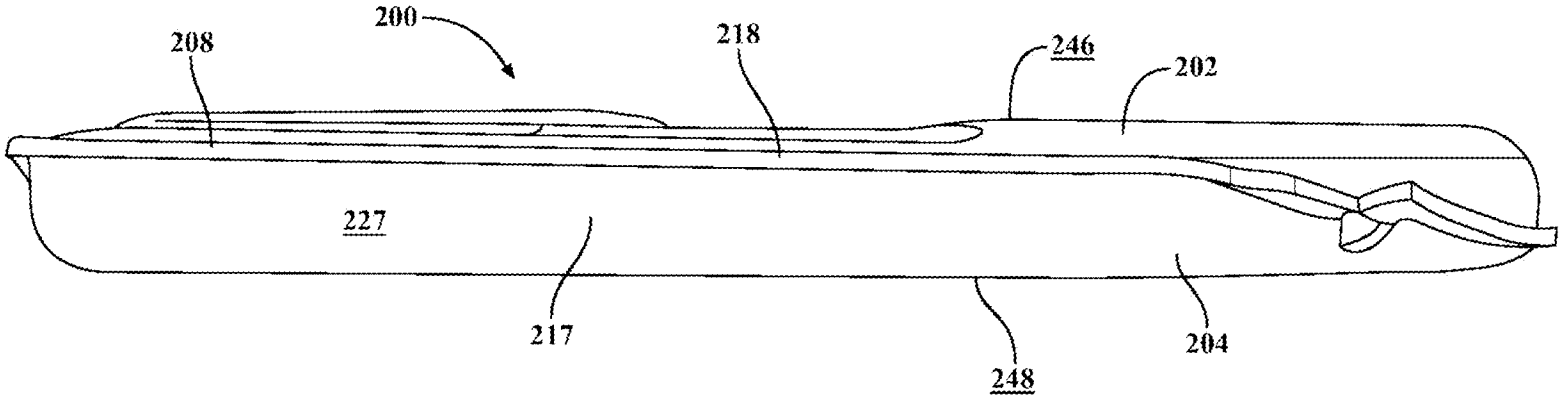
Figure 12:
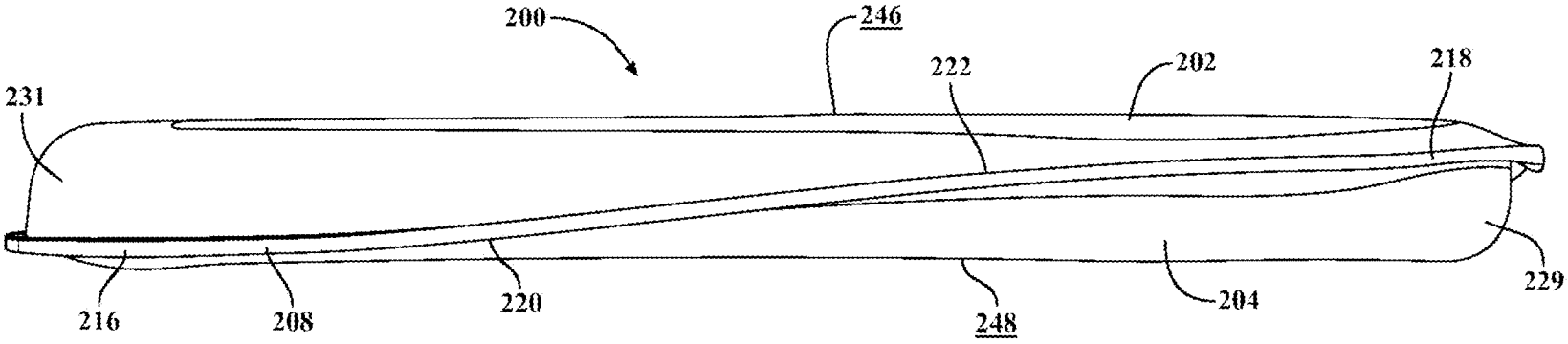
Figure 13:
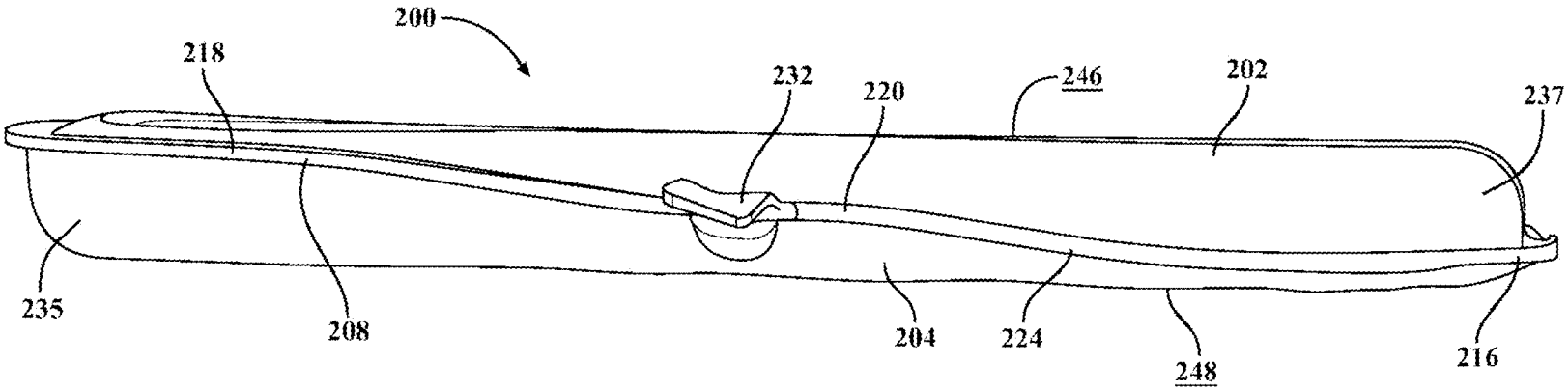
Figure 14:
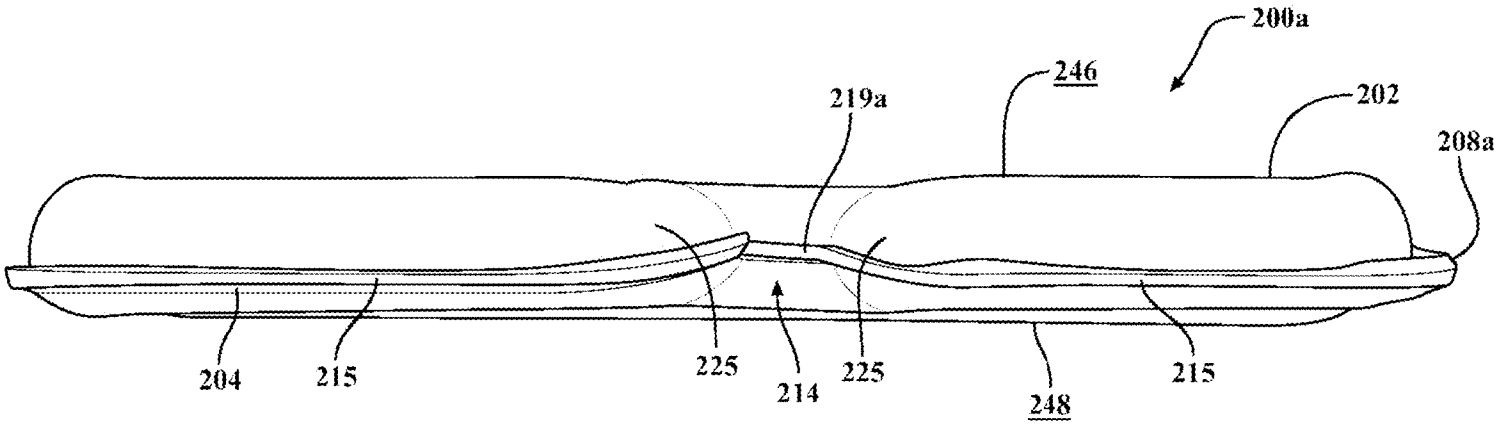
Figure 15:
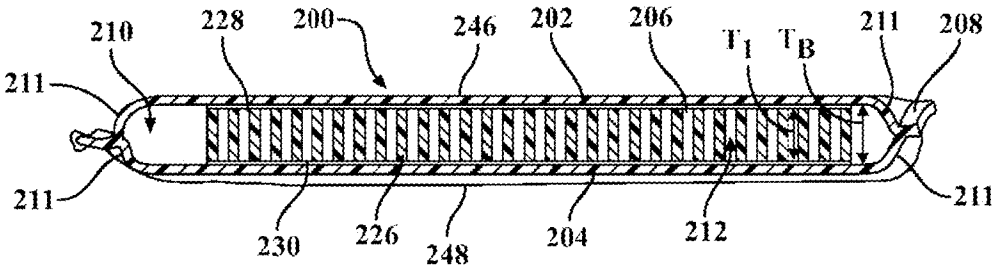
Figure 16:
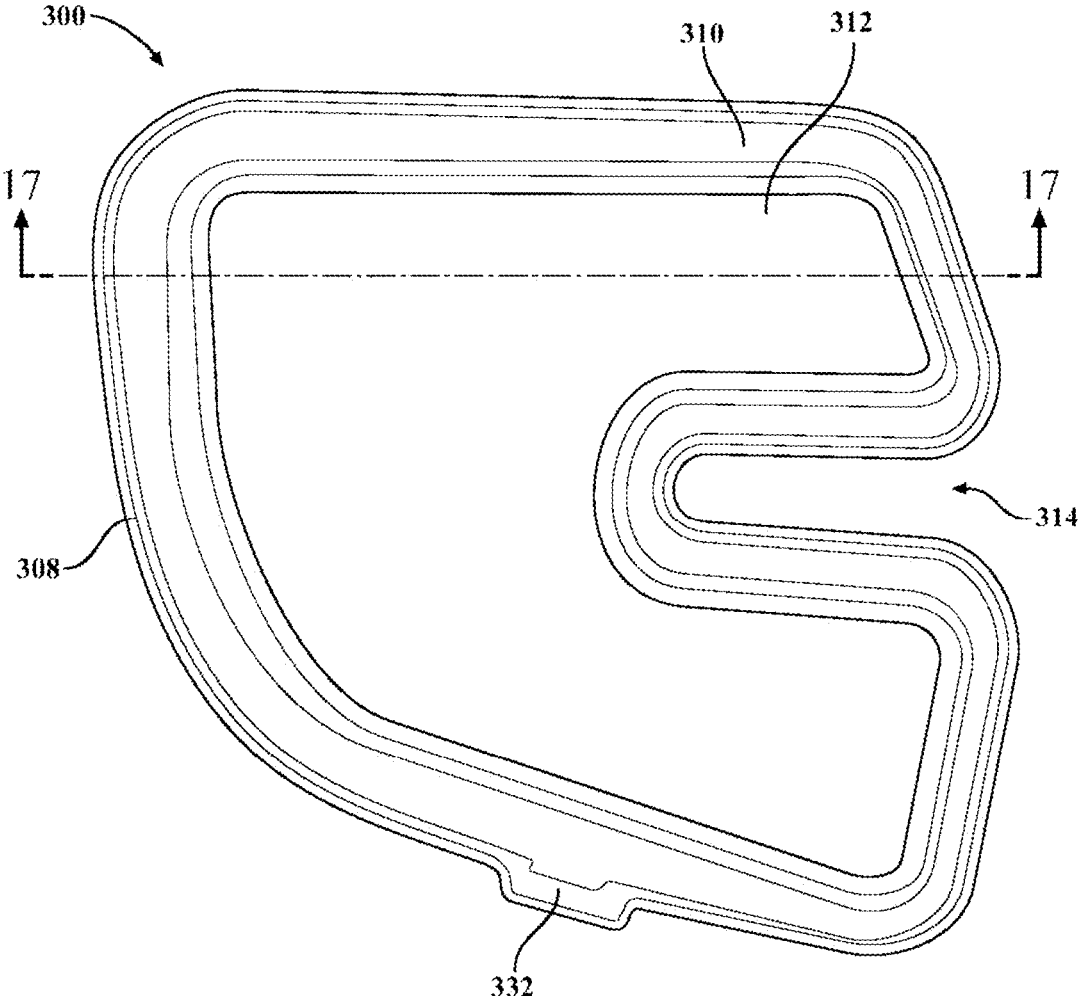
Figure 17:
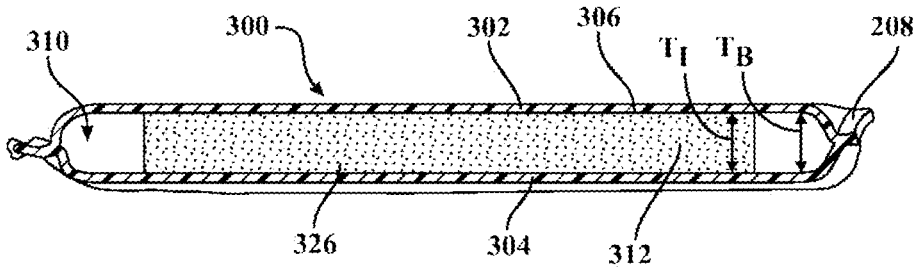
Figure 18:
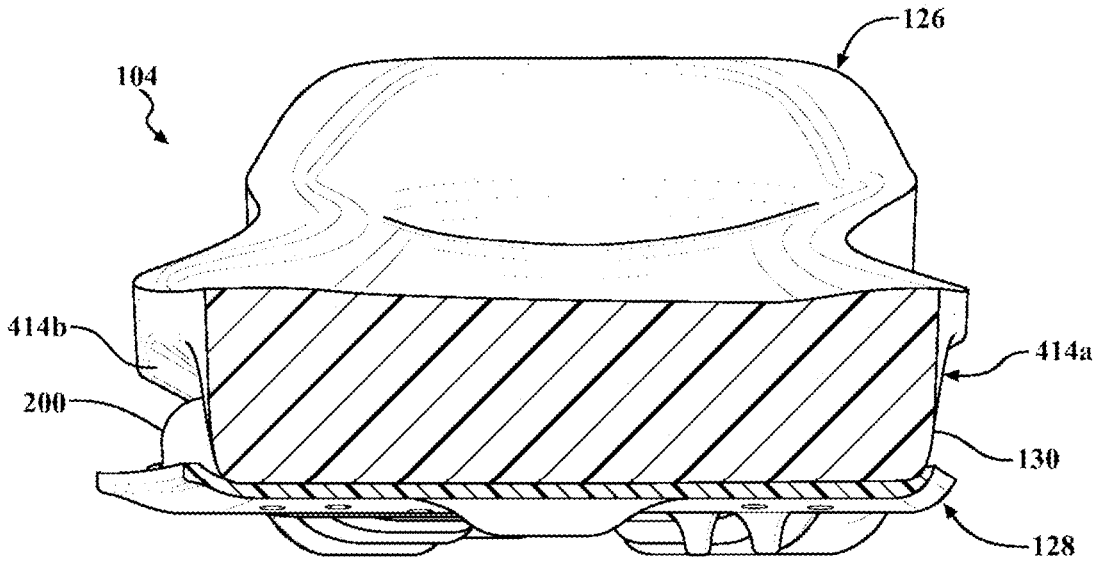
Figure 19:
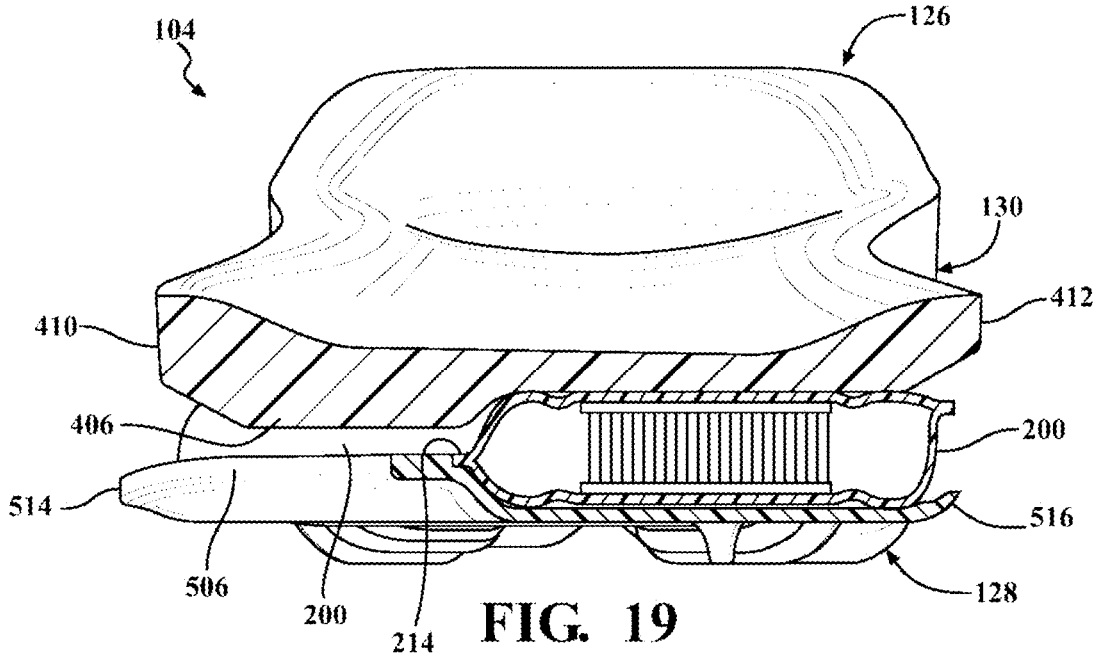
Figure 20:
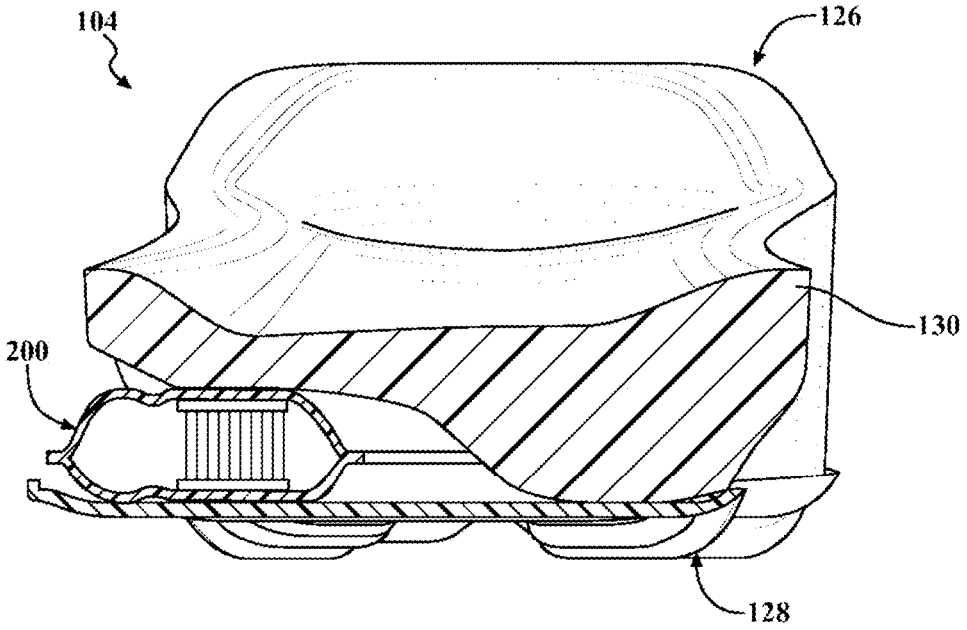
Figure 21:
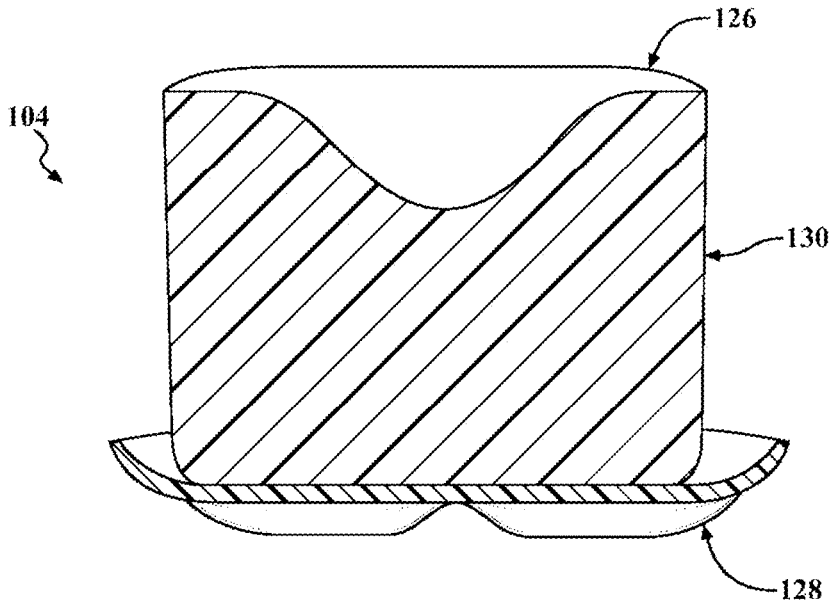
Figure 22:
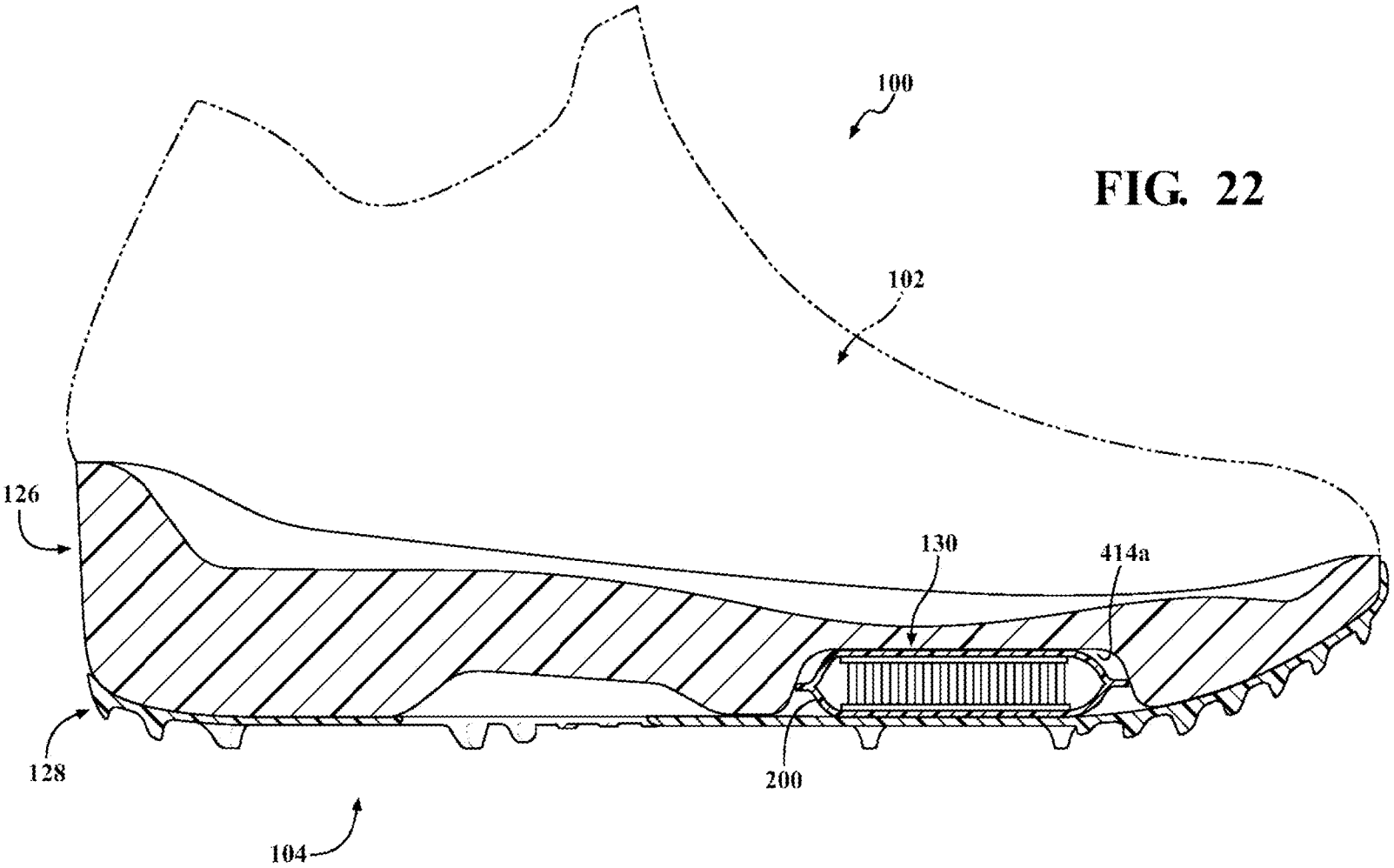

FIG. 7 a perspective view of a bladder of the article of footwear of FIG. 1;

FIG. 8 is a superior side view of the bladder of FIG. 7;

FIG. 9 is an inferior side view of the bladder of FIG. 7;

FIG. 10 is a lateral side view of the bladder of FIG. 7;

FIG. 11 is a medial side view of the bladder of FIG. 7;

FIG. 12 is an anterior side view of the bladder of FIG. 7;

FIG. 13 is a posterior side view of the bladder of FIG. 7;

FIG. 14 is a lateral side view of an alternate configuration for the bladder of FIG. 7;

FIG. 15 is a cross-sectional view of the bladder of FIG. 7, taken along line 15-15 of FIG. 9;

FIG. 16 is a superior view of a bladder in accordance with the principles of the present disclosure;

FIG. 17 is a cross-sectional view of the bladder of FIG. 16, taken along line 17-17 of FIG. 16;

FIG. 18 is a cross-sectional view of the sole structure of FIG. 1, taken along line 18-18 of FIG. 6;

FIG. 19 is a cross-sectional view of the sole structure of FIG. 1, taken along line 19-19 of FIG. 6;

FIG. 20 is a cross-sectional view of the sole structure of FIG. 1, taken along line 20-20 of FIG. 6;

FIG. 21 is a cross-sectional view of the sole structure of FIG. 1, taken along line 21-21 of FIG. 6; and FIG. 22 is a cross-sectional view of the sole structure of FIG. 1, taken along line 22-22 of FIG. 6.

Corresponding reference numerals indicate corresponding parts throughout the drawings.

DETAILED DESCRIPTION

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion ("between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In some aspects, a sole structure for an article of footwear includes a cushioning member that includes a recessed portion and a projection. The sole structure also includes an outsole coupled to the cushioning member. The outsole includes a protrusion. The sole structure further includes a bladder disposed between the cushioning member and the outsole. The bladder includes a first segment and a second segment and defines a notch between the first segment and the second segment. The notch extends from a first edge of the bladder in a direction toward a second edge of the bladder. The projection of the cushioning member and the protrusion of the outsole are at least partially disposed within the notch of the bladder.

In some examples, the notch may include a terminal end and an opening at the first edge. The notch may taper from a direction from the first edge toward the terminal end. The first segment and the second segment may each include a radius that further defines the opening of the notch, and the opening may define the widest point of the notch. Optionally, the bladder may include a first arcuate segment and a second arcuate segment. The first arcuate segment and the second arcuate segment may each be connected to a third edge of the bladder. The third edge may be connected to the first edge of the bladder by the first arcuate segment and may be connected to the second edge of the bladder by the second arcuate segment. In some instances, the bladder may include a planar portion connecting the first arcuate segment and the second arcuate segment.

In further examples, the bladder may define an asymmetric shape about an axis extending through a center of the bladder, and the recessed portion of the cushioning member may define an asymmetric shape about an axis extending through a center of the recessed portion. Optionally, the first segment and the second segment may each include a substantially straight portion extending along a respective axis, and the axis of the first segment may be convergent with the axis of the second segment. In some configurations, the bladder may include a third segment and a fourth segment. The third segment may be defined between the notch and a third edge of the bladder, and the fourth segment may be defined between the notch and a fourth edge of the bladder. The fourth segment may have a length greater than a length of the third segment.

An article of footwear may include the sole structure described above.

In other aspects, a sole structure for an article of footwear includes a cushioning member including a recessed portion and a projection. The sole structure also includes an outsole coupled to the cushioning member and including a protrusion. A bladder is disposed between the cushioning member and the outsole. The bladder includes a first segment and a second segment and defines a notch between the first segment and the second segment. The projection of the cushioning member and the protrusion of the outsole are at least partially disposed within the notch of the bladder. The bladder is asymmetric about an axis extending through the center of the bladder.

In some examples, the notch may extend from a first edge of the bladder toward a second edge of the bladder and may include a terminal end and an opening at a first edge. The notch may taper in a direction from the first edge toward the terminal end. The first segment and the second segment may each include a radius that further defines the opening of the notch, and the opening may define the widest point of the notch. Optionally, the bladder may include a first arcuate segment and a second arcuate segment. The first arcuate segment and the second arcuate segment may each be connected to a third edge of the bladder. The third edge may be connected to the first edge of the bladder by the first arcuate segment and may be connected to the second edge of the bladder by the second arcuate segment. In some instances, the bladder may include a planar portion connecting the first arcuate segment and the second arcuate segment.

In further examples, the bladder may define an asymmetric shape about an axis extending through a center of the bladder, and the recessed portion of the cushioning member may define an asymmetric shape about an axis extending through a center of the recessed portion. Optionally, the first segment and the second segment may each include a substantially straight portion extending along a respective axis, and the axis of the first segment may be convergent with the axis of the second segment. In some configurations, the bladder may include a third segment and a fourth segment. The third segment may be defined between the notch and a third edge of the bladder, and the fourth segment may be defined between the notch and a fourth edge of the bladder. The fourth segment may have a length greater than a length of the third segment.

The details of one or more implementations of the disclosure are set forth in the accompanying drawings and the description below. Other aspects, features, and advantages will be apparent from the description, the drawings, and the claims.

Figure 2:
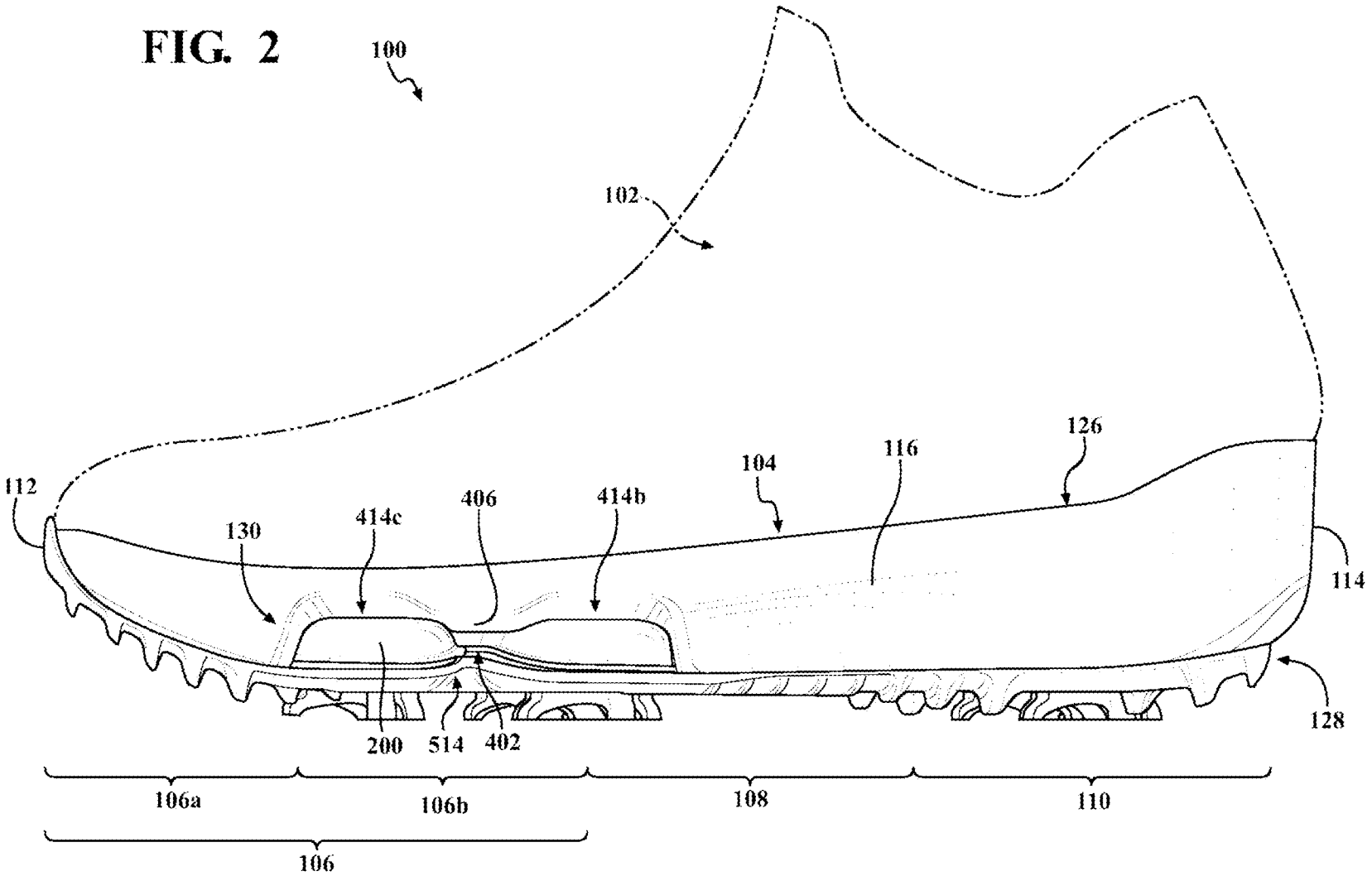
FIG. 2 is a lateral side view of the article of footwear of FIG. 1.

FIGS. 1 and 2 depict an article of footwear 100 in accordance with the principles of the present disclosure. The article of footwear 100 includes an upper 102 and a sole structure 104 and may be divided into one or more regions. Referring to FIG. 2, the regions may include a forefoot region 106, a midfoot region 108, and a heel region 110. The forefoot region 106 may be subdivided into a toe portion **106*a* corresponding with phalanges, and a ball portion 106*b* associated with metatarsal bones of a foot. The midfoot region 108 may correspond with an arch area of the foot while the heel region 110 may correspond with rear portions of the foot, including a calcaneus bone. The footwear 100 may further include an anterior end 112 associated with a forward-most point of the forefoot region 106 and a posterior end 114 associated with a rearward-most point of the heel region 110. A longitudinal axis AF of the footwear 100 extends along a length of the footwear 100 from the anterior end 112 to the posterior end 114, and generally divides the footwear 100 at its widest location into a lateral side 116 and a medial side 118. Accordingly, the lateral side 116 and the medial side 118 respectively correspond with opposite sides of the footwear 100 and extend through the regions 106, 108, 110**.

The upper 102 of the footwear 100 includes interior surfaces that define an interior void 120 configured to receive and secure a foot for support on the sole structure 104. The upper 102 may be formed from one or more materials that are stitched or adhesively bonded together to form the interior void 120. Suitable materials of the upper may include, but are not limited to, mesh, textiles, foam, leather, and synthetic leather. The materials may be selected and located to impart properties of durability, air-permeability, wear-resistance, flexibility, and comfort.

Figure 3:
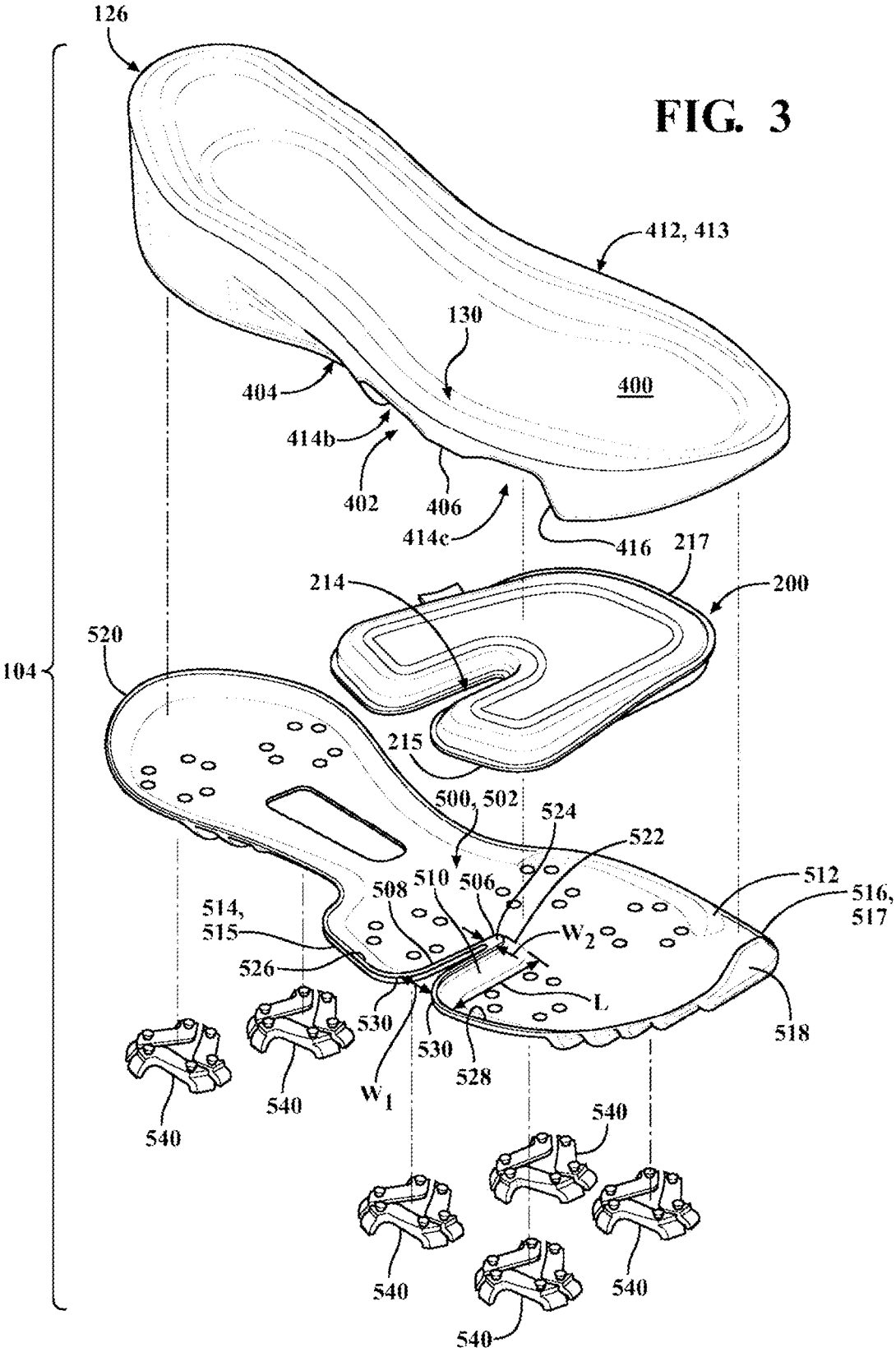
FIG. 3 is a top exploded view of the article of footwear of FIG. 1.
Figure 4:
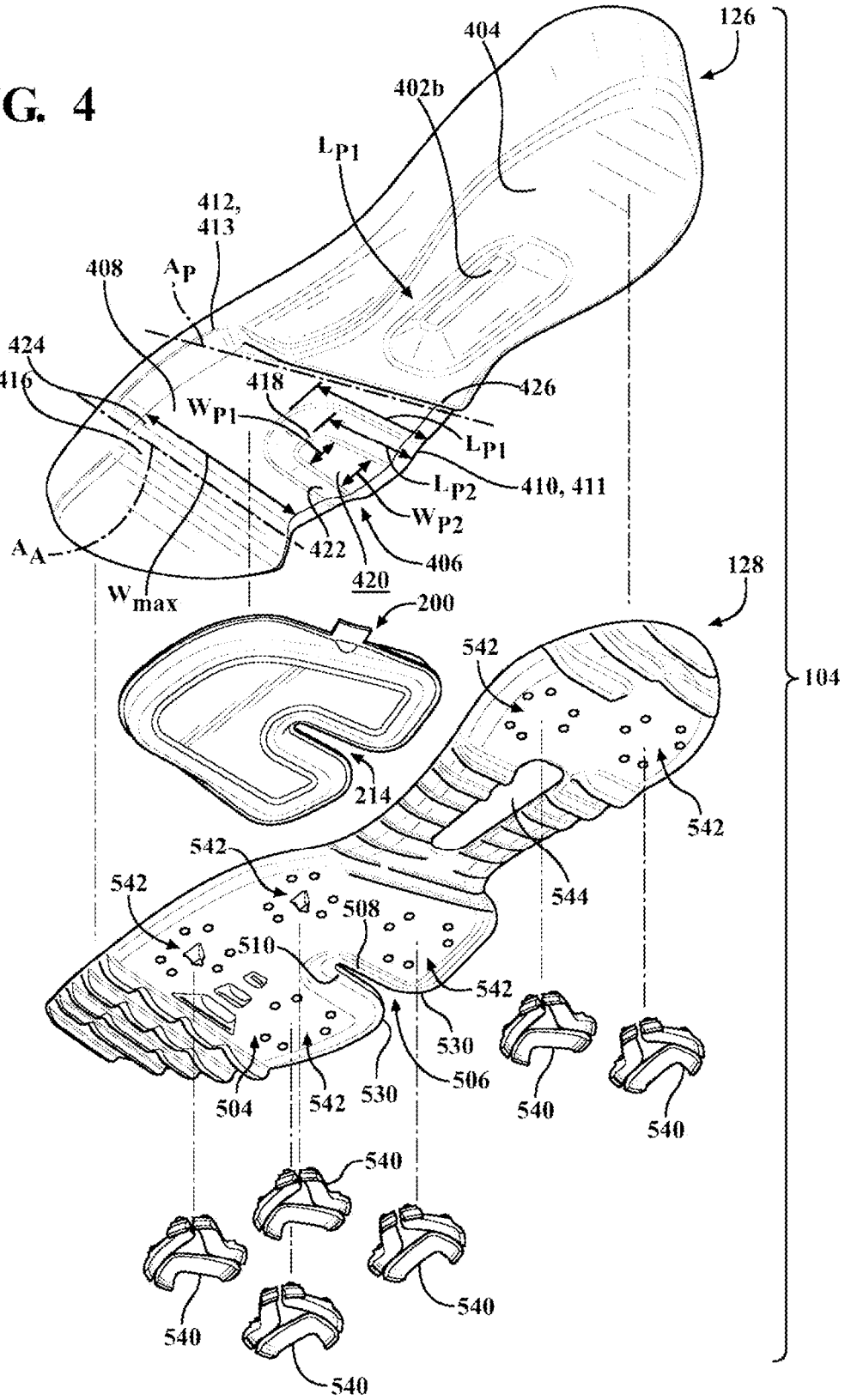
FIG. 4 is a bottom exploded view of the article of footwear of FIG. 1.
Figure 5:
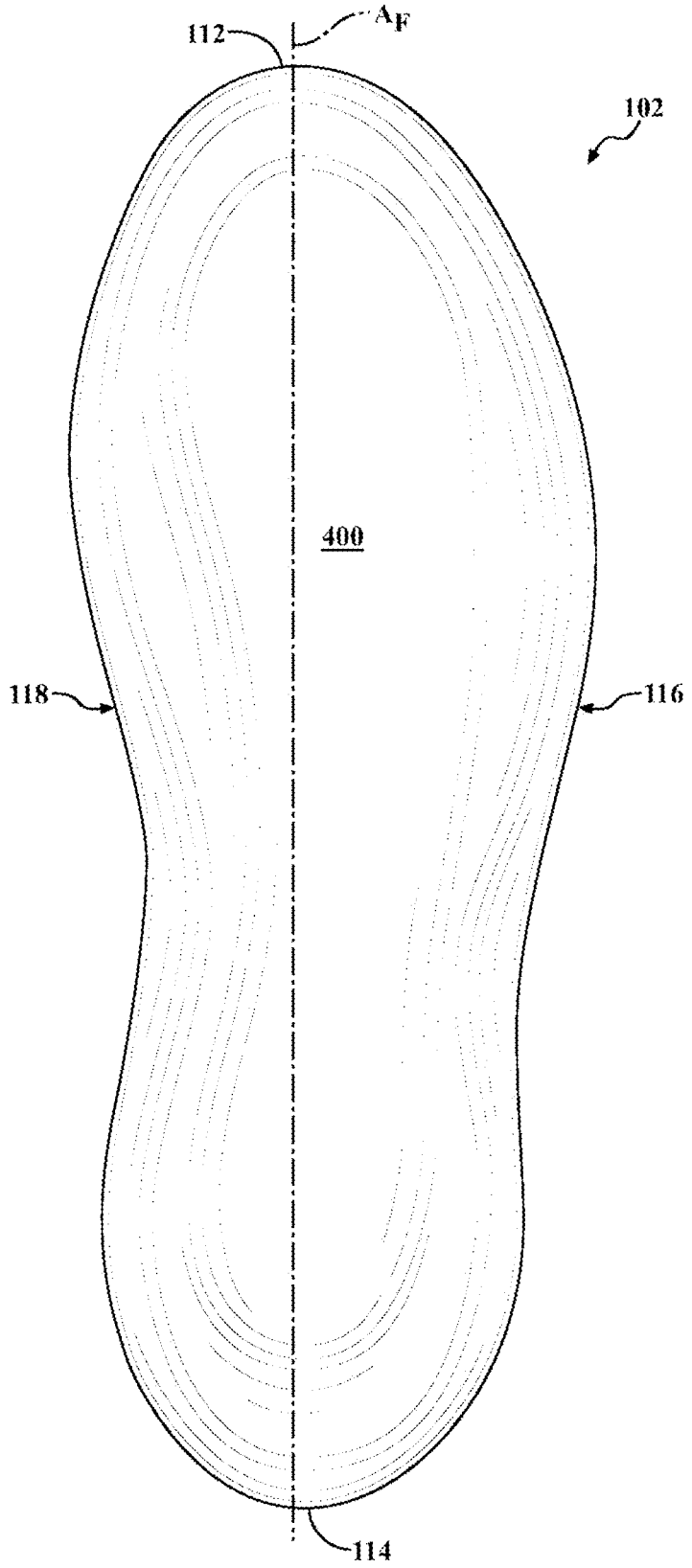
FIG. 5 is a top view of the sole structure of FIG. 1.

Referring to FIG. 1, the sole structure 104 of the article of footwear 100 includes a midsole 126 and an outsole 128. The midsole 126 provides cushioning characteristics to the sole structure 104 while the outsole 128 provides a primary ground-engaging surface of the article of footwear 100. In some examples, the midsole 126 and/or the outsole 128 can each comprise a plurality of subcomponents. For example, as shown in FIGS. 3 and 4, the midsole 126 includes a bladder 200 and a cushioning member 130 that receives the bladder 200. The bladder 200 is exposed along the lateral side 116 and the medial side 118, as described further below.

FIGS. 7-15 depict the bladder 200 of the midsole 126. Referring to FIG. 15, the bladder 200 includes an opposing pair of barrier elements 202, 204 that can be joined to each other at discrete locations to define a chamber 206 and a peripheral seam 208. In the illustrated configuration, the barrier elements 202, 204 include a first, superior barrier element 202 (e.g., an "upper barrier element 202" when disposed within the midsole 126) and a second, inferior barrier element 204 (e.g., a "lower barrier element 204" when disposed within the midsole 126). While the chamber 206 is described as being formed from two barrier elements 202, 204, the chamber 206 could be formed from any suitable combination of one or more barrier layers. For example, the chamber 206 could be formed by folding a single sheet on itself and joining the folded sheet into the shape shown in FIG. 8 by welding or otherwise attaching opposing portions of the sheet to one another in the shape shown in FIG. 8 at the peripheral seam 208. As shown, the chamber 206 is generally defined as the space between the barrier elements 202, 204, while the peripheral seam 208 defines an outer periphery of the bladder 200. The peripheral seam 208 is formed by attaching opposing portions of the barrier elements 202, 204 together by welding or adhesively bonding the elements 202, 204 at the location of the peripheral seam 208. If welding the elements 202, 204 together, heat and/or pressure may be applied to the elements 202, 204 by a suitable process such as, for example, radio frequency (RF) welding to cause a material of the elements 202, 204 to flow and meld together.

As used herein, the term "barrier layer" (e.g., the barrier elements 202, 204) encompasses both monolayer and multilayer films. In some configurations, one or both of barrier elements 202, 204 are each produced (e.g., thermoformed or blow molded) from a monolayer film (a single layer). In other configurations, one or both of barrier elements 202, 204 are each produced (e.g., thermoformed or blow molded) from a multilayer film (multiple sublayers). In either instance, each layer or sublayer can have a film thickness ranging from about 0.2 micrometers to about 1 millimeter. In further configurations, the film thickness for each layer or sublayer can range from about 0.5 micrometers to about 500 micrometers. In yet further configurations, the film thickness for each layer or sublayer can range from about 1 micrometer to about 100 micrometers.

In some examples, the lower barrier element 204 may have a greater thickness than the upper barrier element 202, whereby the lower barrier element 204 is configured to provide a portion of the ground-contacting surface of the article of footwear 100.

One or both of the barrier elements 202, 204 can independently be transparent, translucent, and/or opaque. For example, the upper barrier element 202 may be transparent, while the lower barrier element 204 is opaque. As used herein, the term "transparent" for a barrier layer and/or a fluid-filled chamber means that light passes through the barrier layer in substantially straight lines and a viewer can see through the barrier layer. In comparison, for an opaque barrier layer, light does not pass through the barrier layer, and one cannot see clearly through the barrier layer at all. A translucent barrier layer falls between a transparent barrier layer and an opaque barrier layer. Light passes through a translucent layer but some of the light is scattered so that a viewer cannot see clearly through the layer.

Barrier elements 202, 204 can each be produced from an elastomeric material that includes one or more thermoplastic polymers and/or one or more cross-linkable polymers. In some instances, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, the term "polyurethane" refers to a copolymer (including oligomers) that contains a urethane group (—N(C—O)O—). These polyurethanes can contain additional groups such as ester, ether, urea, allophanate, biuret, carbodiimide, oxazolidinyl, isocynaurate, uretdione, carbonate, and the like, in addition to urethane groups. In some instances, one or more of the polyurethanes can be produced by polymerizing one or more isocyanates with one or more polyols to produce copolymer chains having (—N(C—O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4,4'-diisocyanate (DDDI), 4,4'-dibenzyl diisocyanate (DBDI), 4-chloro-1,3-phenylene diisocyanate, and combinations thereof. In some configurations, the copolymer chains are substantially free of aromatic groups.

In particular instances, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In other instances, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials as well as with the TPU copolymers described herein and optionally including combinations of polyimides and crystalline polymers, are also suitable.

The barrier elements 202, 204 may include two or more sublayers (multilayer film) such as described in U.S. Pat. Nos. 5,713,141 and 5,952,065, which are incorporated by reference herein. In examples where the barrier elements 202, 204 include two or more sublayers, examples of suitable multilayer films include microlayer films such as those disclosed in U.S. Pat. No. 6,582,786, which is incorporated by reference herein. In further examples, the barrier elements 202, 204 may each independently include alternating sublayers of one or more TPU copolymer materials and one or more EVOH copolymer materials, where the total number of sublayers in each of barrier elements 202, 204 includes at least four sublayers, at least ten sublayers, at least twenty sublayers, at least forty sublayers, and/or at least sixty sublayers.

The chamber 206 can be produced from barrier elements 202, 204 using any suitable technique, such as thermoforming (e.g., vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In some examples, the barrier elements 202, 204 can be produced by co-extrusion followed by vacuum thermoforming to produce the chamber 206, which can optionally include one or more valves (e.g., one-way valves) that allows the chamber 206 to be filled with the fluid (e.g., gas). Additional details regarding forming the chamber 206 are provided below.

The chamber 206 can be provided in a fluid-filled (e.g., as provided in the footwear 100) or in an unfilled state. The chamber 206 can be filled to include any suitable fluid, such as a gas or liquid. In an aspect, the gas can include air, nitrogen ($N_2$), or any other suitable gas. In other instances, the chamber 206 can alternatively include other media, such as pellets, beads, ground recycled material, and the like (e.g., foamed beads and/or rubber beads). The fluid provided to the chamber 206 can result in the chamber 206 being pressurized. Alternatively, the fluid provided to the chamber 206 can be at atmospheric pressure such that the chamber 206 is not pressurized but, rather, contains a volume of fluid at atmospheric pressure.

The chamber 206 desirably has a low gas transmission rate to preserve its retained gas pressure. In some examples, the chamber 206 has a gas transmission rate for nitrogen gas that is at least about ten times lower than a nitrogen gas transmission rate for a butyl rubber layer of substantially the same dimensions. In particular instances, the chamber 206 has a nitrogen gas transmission rate of 15 cubic-centimeter/square-meter atmosphere day (cm3/m2·atm·day) or less for an average film thickness of 500 micrometers (based on thicknesses of barrier elements 202, 204). In further instances, the transmission rate is 10 cm3/m2·atm·day or less, 5 cm3/m2·atm·day or less, or 1 cm3/m2·atm·day or less.

In some implementations, the upper barrier element 202 and the lower barrier element 204 cooperate to define a geometry (e.g., thicknesses, width, and lengths) of the chamber 206. For example, the peripheral seam 208 may cooperate to bound and extend around the chamber 206 to seal the fluid (e.g., air) within the chamber 206. Thus, the chamber 206 is associated with an area of the bladder 200 where interior surfaces of the upper and lower barrier elements 202, 204 are separated from one another.

The space formed between opposing interior surfaces of the upper and lower barrier elements 202, 204 defines an interior void of the chamber 206. Similarly, the exterior surfaces of the upper and lower barrier elements 202, 204 define an exterior profile of the chamber 206. Accordingly, the upper and lower barrier elements 202, 204 define respective upper and lower surfaces of the bladder 200.

As shown in FIGS. 7 and 15, the chamber 206 comprises a border portion 210 (which can also be called "an accumulator portion") and an interior portion 212. The border portion 210 and the interior portion 212 are in fluid communication with one another. The border portion 210 is disposed adjacent to the peripheral seam 208 and extends inwardly toward the interior portion 212. In one configuration, the border portion 210 has a thickness $T_B$ that is greater than a thickness $T_I$ of the interior portion 212. In other configurations, the thickness of the bladder 200 is substantially the same at the border portion 210 and at the interior portion 212, as shown in FIG. 15. In this configuration, and as shown in FIG. 15, thickness $T_B$ is substantially equal to thickness $T_I$.

When assembled within the sole structure 104, the border portion 210 of the bladder 200 (i.e., an outer, peripheral edge of the bladder 200) may be at least partially exposed along a peripheral edge of the sole structure 104. For example, as depicted in FIGS. 1 and 2, the border portion 210 is exposed along the lateral side 116 and the medial side 118 of the sole structure 104.

Referring to FIG. 15, the border portion 210 of the chamber 206 has curved, outwardly facing surfaces. Namely, the outer, peripheral edge of the border portion 210 includes arcuate surfaces 211 that meet at the peripheral seam 208. As such, the border portion 210 comprises a generally D-shaped cross-sectional profile when viewed from the perspective depicted in FIG. 15. In other examples, the border portion 210 can comprise various other cross-sectional profiles (e.g., rectangular, ovular, circular, and/or other standard or non-standard geometric shapes). The interior portion 212 of the chamber 206 comprises a generally rectangular cross-sectional profile. In the depicted example, the border portion and the interior portion each have substantially uniform thicknesses and uniform shapes throughout. In other examples, the border portion and the interior portion each have non-uniform thicknesses and non-uniform shapes throughout.

Referring now to FIG. 8, the bladder 200 may include a notch 214. The notch 214 extends inwardly from a lateral edge 215 of the bladder 200 toward a medial edge 217 of the bladder 200 to form a channel in the bladder 200. The terms "medial" and "lateral" are used to designate the position of the edges 215, 217 when the bladder 200 is incorporated into the sole structure 104. The edges 215, 217, are disposed on opposite sides of the bladder 200 from one another. As such, the notch 214 extends into the bladder 200 from a first edge 215 and in a direction toward an opposite side of the bladder 200 (i.e., toward a second edge 217 formed on an opposite side of the bladder 200 than the first edge 215).

The notch 214 is positioned within the bladder 200 in an effort to improve the flexibility of the bladder 200 and, thus, improve the flexibility of the sole structure 104 and footwear 100 incorporating the bladder 200. In some instances, the notch 214 can increase the flexibility of the bladder by up to 50%. In particular instances, the notch 214 can increase the flexibility of the bladder 200 by 35-45%. The notch 214 may be aligned with the ball portion of a wearer's foot (e.g., in the metatarsal head region) and can, for example, allow the bladder 200 to articulate (e.g., flex, pivot, etc.) with the wearer's foot. In particular instances, the notch 214 may be aligned with (e.g., at least partially longitudinally overlap)

the first metatarsal head of the wearer's foot. In other instances, the notch 214 may be aligned with the second metatarsal head of the wearer's foot. In other instances, the notch 214 may be aligned with the third metatarsal head of the wearer's foot. In other instances, the notch 214 may be aligned with the fourth metatarsal head of the wearer's foot. In other instances, the notch 214 may be aligned with the fifth metatarsal head of the wearer's foot.

In some examples, the notch 214 may include a substantially uniform width. In such examples, the notch 214 includes a first width $W_{N1}$ adjacent to the lateral edge 215 of the bladder 200 and a second width $W_{N2}$ proximate to a terminal end 219 of the notch 214. In this configuration, the widths $W_{N1}$ and $W_{N2}$ are approximately equal to one another such that the first width $W_{N1}$ and the second width $W_{N2}$ are within 3% of one another. In this manner, the notch 214 comprises a substantially "U" shape. The first width $W_{N1}$ and the second width $W_{N2}$ are measured between radii of curvature where the edges of the bladder 200 defining the notch 214 extend at least substantially in a medial/lateral direction. In other examples, the notch 214 may include a non-uniform width. In such examples, the first width $W_{N1}$ and the second width $W_{N2}$ differ by more than 3%, as shown in FIGS. 8 and 9. In these cases, the notch 214 comprises a substantially "V" or "tapered" shape. When the notch 214 is tapered, the notch 214 tapers in a direction from the lateral edge 215 toward the terminal end 219 such that the notch 214 decreases in width from the lateral edge 215 to the terminal end 219 (i.e., in a direction from the lateral edge 215 toward the medial edge 217). Such tapering can be constant, as shown in FIGS. 8 and 9, or can vary along the length of the notch 214 from the lateral edge 215 to the terminal end 219. In other instances, the notch 214 can comprise various other shapes and/or widths.

The notch 214 comprises a length $L_N$ defined as a straight-line distance from an opening of the notch 214 at the lateral edge 215 to the terminal end 219. In the event that the medial and/or lateral edges are curves, the length $L_N$ can be the distance between tangent lines intersecting the curves.

In some examples, the length $L_N$ of the notch 214 can be less than 50% of a max width $W_{max}$ of the bladder 200 (FIG. 8). In some examples, the length $L_N$ of the notch 214 can be less than 40% of the max width $W_{max}$ of the bladder 200. In some examples, the length $L_N$ of the notch 214 can be less than 30% of the max width $W_{max}$ of the bladder 200. In some examples, the length $L_N$ of the notch 214 can be less than 20% of the max width $W_{max}$ of the bladder 200. In particular examples, the length $L_N$ of the notch 214 can be within a range of 10-50% of the max width $W_{max}$ of the bladder 200. In certain examples, the length $L_N$ of the notch 214 can be within a range of 20-40% of the max width $W_{max}$ of the bladder 200.

In one configuration, the border portion 210 of the bladder 200 that defines the notch 214 can have a reduced thickness compared to other locations of the border portion 210 (e.g., the lateral edge 215 and the medial edge 217). Reducing the thickness of the border portion 210 around the notch 214 (e.g., to a thickness equal to or less than the thickness $T_I$ of the interior portion) can, for example, improve the feel of the bladder 200 under the wearer's foot.

As shown in FIGS. 8 and 9, the lateral edge 215 and the medial edge 217 are disposed on opposite sides of the bladder 200 and are spaced apart from one another by an anterior edge 222 and a posterior edge 224. The terms "anterior" and "posterior" refer to the positions of the bladder 200 when incorporated into the sole structure 104. Namely, the anterior edge 222 is disposed proximate to the anterior end 112 within the forefoot region 106 while the posterior edge 224 is disposed between the anterior edge 222 and the posterior end 114 and is located within the forefoot region 106 and the midfoot region 108. While these edges 222, 224 will be described hereinafter as being an anterior edge 222 and a posterior edge 224, these edges 222, 224 could alternatively be referred to as a third edge 222 and a fourth edge 224 when referencing the edges 222, 224 apart from the sole structure 104.

The lateral edge 215 may be disposed proximate to the lateral side 116 when incorporated into the sole structure 104 and may include a first segment 221 and a second segment 223. The first segment 221 is separated from the second segment 223 by the notch 214. Each segment 221, 223 includes a substantially straight portion extending along an axis $A_{221}$, $A_{223}$. As shown in FIG. 8, these axes $A_{221}$, $A_{223}$ are convergent with one another and are located on opposite sides of the notch 214. The first segment 221 and the second segment 223 each terminate at the notch 214. As shown, the segments 221, 223 transition into the notch 214 at a radius 225. The radius 225 associated with the first segment 221 and the radius 225 associated with the second segment 223 cooperate to define an opening to the notch 214 as well as the widest point of the notch 214.

As described above, the notch 214 may taper in a direction from the lateral edge 215 to the terminal end 219. As shown in FIGS. 8 and 9, the opening of the notch 214 is the widest point of the notch 214 and may include a different taper than the rest of the notch 214. For example, the notch 214 may taper to a greater extent at the portion of the notch 214 defined by the radii 225 as comparted to the portion of the notch 214 extending between the radii 225 and the terminal end 219.

The medial edge 217 is disposed on an opposite side of the bladder 200 than the lateral edge 215 and includes a substantially convex surface 227. The convex surface 227 may provide the medial edge 217 with a curved profile that matches or is substantially similar to a curvature of the midsole 126. Providing the medial edge 217 with a curved profile that is similar to that of the midsole 126 allows the bladder 200 to align with an outer edge of the midsole 126 and, in so doing, maximize the amount of coverage the bladder 200 provides.

The anterior edge 222 extends between and connects the first segment 221 of the lateral edge 215 and the convex surface 227 of the medial edge 217. As shown in FIGS. 8 and 9, the anterior edge 222 is connected to the first segment 221 of the lateral edge 215 by an arcuate segment 229 and is connected to the medial edge 217 by an arcuate segment 231. The anterior edge 222 includes a substantially planar portion 233 extending between and connecting the arcuate segment 229 and the arcuate segment 233. The planar portion 233 extends along an axis $A_{233}$.

The posterior edge 224 extends between the second segment 223 of the lateral edge 215 and the convex surface 227 of the medial edge 217. As shown in FIGS. 8 and 9, the posterior edge 224 is connected to the second segment 223 of the lateral edge 215 by an arcuate segment 235 and is connected to the medial edge 217 by an arcuate segment 237. The posterior edge 224 includes a substantially planar portion 239 extending between and connecting the arcuate segment 235 and the arcuate segment 237. The planar portion 239 extends along an axis $A_{239}$.

The foregoing edges 215, 217, 222, 224 provide the bladder 200 with an asymmetric shape. Namely, the bladder 200 is asymmetric about an axis extending through the center of the bladder 200 from the lateral edge 215 to the medial edge 217 and is asymmetric about an axis extending through the center of the bladder 200 from the anterior edge 222 to the posterior edge 224.

With continued reference to FIGS. 8 and 9, the axis $A_{233}$ and the axis $A_{239}$ are shown as being convergent with one another. In the configuration shown in FIG. 9, the axes $A_{233}$, $A_{239}$ extend in a direction away from one another at the lateral edge 215. The axes $A_{233}$, $A_{239}$ extend away from one another at the lateral edge 215 due to the shape of the bladder 200 on either side of the notch 214. Specifically, the bladder 200 includes a first segment 240 disposed between the notch 214 and the anterior edge 222 and a second segment 242 disposed between the notch 214 and the posterior edge 224. The first segment 240 and the second segment 242 extend from a common location 244 between the terminal end 219 of the notch 214 and the medial edge 217. The first segment 240 extends from the medial edge 217 to the first segment 221 of the lateral edge 215. Similarly, the second segment 242 extends from the medial edge 217 to the second segment 223 of the lateral edge 215. As shown, the second segment 242 may be longer than the first segment 240. The second segment 242 may be longer than the first segment 240 to allow the second segment 242 to extend from the medial side 118 of the sole structure 104 within the forefoot region 106 to the lateral side 116 of the sole structure 104 in the midfoot region 108. This way, the bladder 200 can maximize coverage to enhance cushioning and support during wear.

Referring now to FIGS. 10-14, the peripheral seam 208 of the bladder 200 can comprise a first segment 216 disposed adjacent to an inferior surface 248 of the bladder 200 defined by the second barrier element 204 and a second segment 218 disposed adjacent to a superior surface 246 of the bladder 200 defined by the first barrier element 202. The peripheral seam 208 can also include a transition segment 220 disposed between the first segment 216 and the second segment 218. As shown in FIGS. 10, 12, and 13, the first segment 216 of the peripheral seam 208 is disposed on the lateral, anterior, and posterior sides of the bladder 200. As shown in FIGS. 11-13, the second segment 218 of the peripheral seam 208 is disposed on the medial, anterior, and posterior sides of the bladder 200. As shown in FIGS. 12 and 13, the transition segment 220 of the peripheral seam 208 is disposed on the anterior and posterior sides of the bladder 200. In this manner, the peripheral seam 208 of the bladder 200 can be referred to as "a jogged seam" (e.g., the seam 208 "jogs" from the inferior surface 248 to the superior surface 246 of the bladder 200 around a periphery of the bladder 200) and extends through a majority of a thickness of the bladder 200 from the inferior surface 248 to the superior surface 246.

Configuring the bladder 200 with a jogged peripheral seam can, for example, provide functional and/or aesthetic benefits. As one example, a bladder can have one or more functional and/or aesthetical properties on a first portion of the bladder (e.g., a lateral side) and one or more different functional and/or aesthetic properties on a second portion of the bladder (e.g., a medial side), as will be described in more detail below.

The first segment 216 of the peripheral seam 208 is disposed proximate to or substantially aligned with the inferior surface 248 of the bladder 200 and is disposed on the lateral side 116 of the footwear 100. This configuration can, for example, provide the functional benefit of increased stability. Namely, locating the peripheral seam 208 proximate to the inferior surface 248 likewise positions the peripheral seam 208 proximate to the outsole 128. In so doing, the relatively rigid seam 208 (created by melding a material of the first barrier element 202 and the second barrier element 204 together) is attached to the midsole 126 proximate to a junction of the midsole 126 and the outsole 128, which allows the rigid seam 208 to act as an anchor and resist deformation of the bladder 200 during cutting or side-to-side movements. The configuration also provides an aesthetic benefit, as the first segment 216 of the peripheral seam 208 is hidden from the perspective of someone looking downwardly at the footwear 100. The first segment 216 is hidden by a material of the midsole 126 and/or a material of the outsole 128 such that only the upper barrier element 202 is visible at a periphery of the sole structure 104.

The second segment 218 of the peripheral seam 208 is disposed proximate to or substantially aligned with the superior surface 246 of the bladder 200 and is disposed on the medial side 118 of the footwear 100. This configuration can, for example, facilitate installation of the bladder 200 into the midsole 126 of the sole structure 104. For example, positioning the peripheral seam 208 proximate to or aligned with the superior surface 246 allows the lower barrier element 204 to have a reduced profile due to the material of the seam 208 being moved proximate to the top of the bladder 200. In so doing, a material of the midsole 126 and/or the outsole 128 can more easily wrap up onto the second barrier element 204 by having an increased radius and, further, can allow the outsole 128 and, thus, the sole structure 104, to have a reduced profile.

With reference to FIG. 14, an alternate configuration of the peripheral seam 208 is provided. The peripheral seam shown in FIG. 14 is identical to the peripheral seam 208 shown in FIG. 10 with the exception of the portion of the seam located within the notch 214. Accordingly, like reference numerals are used hereinafter and in drawings to identify like components while like reference numerals containing a letter extension are used to identify those components that have been modified.

In the configuration shown in FIG. 14, a bladder **200*a* is shown having a peripheral seam 208*a* that extends into the notch 214 but, rather than having the seam located proximate to the inferior surface 248 along both edges of the notch 214, as shown in FIG. 10, the peripheral seam 208*a* extends in a direction toward the superior surface 246 proximate to the radius 225 associated with the first segment 221 and the second segment 223 of the lateral edge 215. This portion of the peripheral seam 208*a* then extends along the notch 214 at an approximate midpoint of a thickness of the bladder 200*a* (i.e., substantially centrally located between the superior surface 246 and the inferior surface 248). Accordingly, the peripheral seam 208*a* extends into the notch 214 at a location that is higher or closer to the superior surface 246 when comparted to the peripheral seam 208 of the bladder 200 (FIG. 10). As shown in FIG. 14, the resulting seam 208*a* extends around a periphery of the bladder 200*a* within the notch 214 at a location that is at an approximate midpoint of a thickness of the bladder 200*a* from an opening of the notch 214 at the first segment 221, to a distal end 219*a* of the notch 214, and from the distal end 219*a* to the second segment 223**.

Extending the peripheral seam **208*a* into the notch 214 such that the peripheral seam 208*a* extends proximate to a midpoint of a thickness of the bladder 200*a* within the notch 214 facilitates compression of the bladder 200*a* by requiring less force to collapse the bladder 200*a* along the length of the notch 214 and at the terminal end 219*a* as compared to the bladder 200**.

The jogged seams 208, **208*a* provide manufacturing and weight advantages in addition to the performance advantages outlined above. Namely, the jogged seams 208, 208*a*** allow for use of thinner barrier elements when compared to conventional bladders. This is due to the fact that the barrier layers are not required to have a deep draw around an entire perimeter thereof during formation of the bladder 200, 200*a*. Rather, when the seam 208, 208*a* is aligned with or substantially aligned with a surface 246, 248 of the respective barrier elements 202, 204, the draw required to form the bladder 200, 200*a* at these locations is minimal, thereby allowing for use of a thinner barrier layer during manufacturing. Further, use of relatively thinner barrier layers distributes material stretching more evenly across both barrier elements 202, 204, as compared to forming the entire border portion 210 in a single barrier layer. Alternatively, if barrier layers of typical thickness are used, the bladder 200 will be more stable and/or resilient due to use of the jogged seam 208, 208*a*, as each barrier element 202, 204 undergoes less deformation because only a portion of the layer is stretched.

In some instances, a first barrier layer can comprise one or more properties (e.g., color, opacity, translucency, thickness, material type, etc.), and a second barrier layer can comprise one or more different properties. The different barrier layers can, for example, create different performance and/or aesthetic properties. For example, a bladder with a jogged seam and barrier layers of different color can be configured such that the bladder appears to have a first color on a first portion (e.g., a lateral side) of the footwear and a second color on a second portion (e.g., a medial side) of the footwear.

In the depicted example, the transition segment 220 of the peripheral seam 208 is positioned such that it is not visible to the wearer and/or an observer when the footwear 100 is assembled. The transition segment 220 may extend along a length of the bladder 200 from a first end of the bladder 200 to a second end of the bladder 200, as shown in FIGS. 12 and 13. The transition segment 220 extends between and connects the first segment 216 and the second segment 218 and gradually increases in height from the first segment 216 to the second segment 218. In one configuration, the transition segment 220 increases in height at a constant rate between the first segment 216 and the second segment 218 such that the transition segment 220 has a substantially constant slope. In other configurations, the transition segment 220 may include a different slope between the first segment 216 and the second segment 218 for at least a portion of the length of the transition segment 220.

The bladder 200 can comprise various shapes. For example, as shown in FIG. 8, the medial and/or posterior sides of the bladder 200 can comprise an arcuate or curved shape. The lateral edge 215 can be angled or tapered from the notch 214 in the anterior-medial and/or posterior-medial directions. In other words, the bladder 200 is wider adjacent to the notch 214 than at the anterior-lateral and/or posterior-lateral corners of the bladder 200. When viewed from the superior side (e.g., FIG. 8), the bladder comprises a substantially "C" shape. In other examples, various other shapes, degrees of curvature, degrees of taper, etc. can be used.

It should be noted that, although the bladder 200 comprises a notch 214 and a jogged peripheral seam 208, a bladder can comprise any one of these features without having one or more of the others. For example, a bladder can comprise a jogged peripheral seam and not comprise a notch. As another example, a bladder can comprise a notch and not comprise a jogged peripheral seam.

In addition to being filled with a fluid, in some instances, at least a portion of a chamber of a bladder can be filled with one or more components. The filling material/components can, for example, improve the resiliency and/or durability of the bladder.

For example, referring to FIG. 15, the chamber 206 of the bladder 200 includes one or more tensile strands 226 disposed therein. In some examples, the tensile strands 226 can be referred to as tensile elements. Each tensile strand 226 can extend between an upper tensile sheet 228 and a lower tensile sheet 230. The upper tensile sheet 228 may be attached to the first barrier element 202 while the lower tensile sheet 230 may be attached to the second barrier element 204. In this manner, when the chamber 206 of the bladder 200 receives a pressurized fluid, the tensile strands 226 are placed in tension. Because the upper tensile sheet 228 is attached to the first barrier element 202 and the lower tensile sheet 230 is attached to the second barrier element 204, the tensile strands 226 retain a desired shape of the chamber 206 when pressurized fluid is injected into the chamber via a port 232.

In lieu of or in addition to the tensile strands, in some instances, a bladder can comprise a foam element disposed within a chamber of the bladder. For example, FIGS. 16 and 17 depict a bladder 300. The bladder 300 is configured similar to the bladder 200, except that the bladder 300 comprises a foam element 326 disposed in an interior portion 312 of a chamber 306 of the bladder 300 rather than having tensile strands 226 disposed in the chamber 206 like the bladder 200. Given the similarities between the bladder 200 and the bladder 300, the reference numerals of the bladder 300 correspond to similar components of the bladder 200, unless stated otherwise. Namely, one hundred (100) is added to the corresponding reference number from the bladder 200 to identify like components in the bladder 300. For example, reference numerals 302 and 304 respectively correspond to reference numerals 202 and 204 in the bladder 200.

The bladder 300 can, for example, be used with the footwear 100 in lieu of the bladder 200. As with the bladder 200, the bladder 300 can be pressurized to a pressure above ambient pressure.

The bladders 200 and 300 can be formed in various ways. Several exemplary methods are provided below with respect to the bladder 200. The bladder 300 can be formed in a similar manner.

In some examples, a bladder can be formed without tensile strands and/or a foam element disposed within the chamber. For example, in some instances, the bladder 200 can be filled with a fluid via a port (e.g., the port 232) but not have any other material added to the chamber.

In some implementations, the upper and lower barrier elements 202, 204 are formed by respective mold portions each defining various surfaces for forming depressions and pinched surfaces corresponding to locations where the peripheral seam 208 is formed when the upper barrier element 202 and the lower barrier element 204 are joined and bonded together. In some implementations, adhesive bonding joins the upper barrier element 202 and the lower barrier element 204 to form the peripheral seam 208. In other implementations, the upper barrier element 202 and the lower barrier element 204 are joined to form the peripheral seam 208 by thermal bonding. In some examples, one or both of the barrier elements 202, 204 are heated to a temperature that facilitates shaping and melding. In some examples, the barrier elements 202, 204 are heated prior to being located between their respective molds. In other examples, the mold may be heated to raise the temperature of the barrier elements 202, 204. In some implementations, a molding process used to form the chamber 206 incorporates vacuum ports within mold portions to remove air such that the upper and lower barrier elements 202, 204 are drawn into contact with respective mold portions. In other implementations, fluids such as air may be injected into areas between the upper and lower barrier elements 202, 204 such that the resulting increase in pressure causes the barrier elements 202, 204 to engage with surfaces of their respective mold portions.

The cushioning member 130 and the bladder 200 of the midsole 126 can be configured to mate in various ways. For example, in some instances, the cushioning member 130 can be over-molded onto the bladder 200 such that the bladder 200 is at least partially embedded or encapsulated by the cushioning member 130. In such instances, a top surface 400 of the cushioning member 130 defines a profile of the footbed and may be contoured to correspond to a shape of the foot. Further, a material of the cushioning member 130 may completely or partially fill the notch 214, described below. As shown in FIG. 19, a material of the cushioning member 130 at least partially fills the notch 214 and separates the first segment 221 of the lateral edge 215 from the second segment 223 of the lateral edge 215 at an outer periphery of the sole structure 104.

Referring to FIGS. 3-6 and 18-22, a recessed portion 402 of the cushioning member 130 is defined along a bottom or lower surface 404 of the cushioning member 130 opposing the top surface 400. In some examples, the cushioning member 130 may include a second recessed portion 402*a* defined in the midfoot region 108 (FIG. 2) of the footwear 100. The recessed portion 402 is configured to receive the bladder 200 such that the recessed portion 402 may be contoured to the substantially curved profile of the bladder 200. The recessed portion 402 includes a projection 406 extending from a mating surface 408 of the recessed portion 402 configured to engage with the superior surface 246 of the bladder 200. The projection 406 is illustrated on the lateral side 410 of the cushioning member 130. The medial side 412 of the cushioning member 130 is illustrated with a first opening 414*a*. The projection 406 defines a second opening 414*b* and a third opening 414*c*. Each of the openings 414*a*-414*c* is defined by the mating surface 408 and sidewalls 416 of the recessed portion 402. The openings 414*a*-414*c* expose the bladder 200 within the midsole 126 along each of the lateral side 116 (FIG. 2) and the medial side 118 (FIG. 1) of the midsole 126.

For example, the sidewalls 416 may be substantially sloped or slanted to accommodate the curved, outwardly facing surfaces of the border portion 210 of the bladder 200. Further, the projection 406 extends outwardly from a lateral edge 411 of the recessed portion 402 toward a medial edge 413 of the recessed portion 402. The projection 406 is defined within the recessed portion 402 to engage with the notch 214 of the bladder 200. As mentioned above, the notch 214 is configured to improve the flexibility of the bladder 200. The projection 406 may further assist in providing flexibility by defining a flexion point of the cushioning member 130. The projection 406 may also generally stabilize the bladder 200 by engaging the bladder 200 within the notch 214. Thus, the flexible movement of the footwear 100 during flexion within the forefoot region 106 may be at least partially stabilized by the engagement with the projection 406.

As described above with respect to the notch 214, the projection 406 may be aligned with the ball portion 106*b* of a wearer's foot (e.g., in the metatarsal head region) and can, for example, allow the cushioning member 130 to articulate (e.g., flex, pivot, etc.) with the wearer's foot. In particular instances, the projection 406 may be aligned with (e.g., at least partially longitudinally overlap) the first metatarsal head of the wearer's foot. In other instances, the projection 406 may be aligned with the second metatarsal head of the wearer's foot. In other instances, the projection 406 may be aligned with the third metatarsal head of the wearer's foot. In other instances, the projection 406 may be aligned with the fourth metatarsal head of the wearer's foot. In other instances, the projection 406 may be aligned with the fifth metatarsal head of the wearer's foot.

In some examples, as similarly described with respect to the notch 214, the projection 406 may include a substantially uniform width. In such examples, the projection 406 includes a first width $W_{P1}$ adjacent to the lateral edge 411 of the cushioning member 130 and a second width $W_{P2}$ proximate to a terminal end 418 of the projection 406. In this configuration, the widths $W_{P1}$, $W_{P2}$ are approximately equal to one another such that the first width $W_{P1}$ and the second width $W_{P2}$ are within 3% of one another. In this manner, the projection 406 comprises a substantially "U" shape. The first width $W_{P1}$ and the second width $W_{P2}$ are measured along an engagement surface 420 of the projection 406 within an arcuate perimeter wall 422 of the projection 406. The perimeter wall 422 defines a substantially "U" shape with the engagement surface 420 defined within the perimeter wall 422. The perimeter wall 422 may be sloped or otherwise slanted to project the engagement surface 420 from the mating surface 408 of the cushioning member 130 while maintaining an ergonomic configuration of the cushioning member 130. For example, the perimeter wall 422 has a gradual slope, such that the projection 406 is wider at the mating surface 408 of the cushioning member 130 as compared to the widths $W_{P1}$, $W_{P2}$ defined along the engagement surface 420 of the projection 406.

In other examples, the projection 406 may include a non-uniform width. In such examples, the first width $W_{P1}$ and the second width $W_{P2}$ differ by more than 3%, as shown in FIG. 4. In these cases, the projection 406 comprises a substantially "V" or "tapered" shape. When the projection 406 is tapered, the projection 406 tapers in a direction from the lateral edge 411 toward the terminal end 418 such that the projection 406 decreases in width from the lateral edge 411 to the terminal end 418 (i.e., in a direction from the lateral edge 411 toward the medial edge 413). Such tapering can be constant, as shown in FIG. 4, or can vary along the length of the projection 406 from the lateral edge 411 to the terminal end 418. In other instances, the projection 406 can comprise various other shapes and/or widths.

The projection 406 comprises a first length $L_{P1}$ defined as a straight-line distance from the lateral edge 411 to the terminal end 418 at the perimeter wall 422. As noted above, the perimeter wall 422 may slope from the mating surface 408 of the cushioning member 130 toward the engagement surface 420. Thus, the projection 406 may have a second length $L_{P2}$ defined along the engagement surface 420 as a straight-line distance from the lateral edge 411 to the terminal end 418 at the engagement surface 420. In some examples, the first length $L_{P1}$ may be greater than the second length $L_{P2}$. In the event that the medial and/or lateral edges are curves, the lengths $L_{P1}$, $L_{P2}$ can be the distance between tangent lines intersecting the curves.

In some examples, the length $L_P$ of the projection 406 can be less than 50% of a max width $W_{max}$ of the cushioning member 130 (FIG. 4). In some examples, the length $L_{P1}$ of the projection 406 can be less than 40% of the max width $W_{max}$ of the cushioning member 130. In some examples, the length $L_{P1}$ of the projection 406 can be less than 30% of the max width $W_{max}$ of the cushioning member 130. In some examples, the length $L_{P1}$ of the projection 406 can be less than 20% of the max width $W_{max}$ of the cushioning member 130. In particular examples, the length $L_{P1}$ of the projection 406 can be within a range of 10-50% of the max width $W_{max}$ of the cushioning member 130. In certain examples, the length $L_{P1}$ of the projection 406 can be within a range of 20-40% of the max width $W_{max}$ of the cushioning member 130.

The dimensions of the projection 406 are configured to align with the notch 214. For example, the overall width of the notch 214 may be at least marginally larger than the width of the projection 406 to receive, at least in part, the engagement surface 420 of the projection 406. In some examples, the engagement surface 420 of the projection 406 may be proximate the notch 214 and is engaged with the notch 214 upon application of a force. For example, the wearer's foot may apply pressure onto the projection 406 during wear to engage the engagement surface 420 with the notch 214. Thus, the projection 406 may be at least partially received within the notch 214. In other examples, the projection 406 is configured to be received within the notch 214 upon assembly of the footwear 10. In such examples, the projection 406 may be fully or partially received within the notch 214, as shown in FIG. 19.

The overall configuration and dimensions of the recessed portion 402 are configured to align with the dimensions of the bladder 200 in that the recessed portion 402 has marginally larger dimensions as compared to the bladder 200 to receive the bladder 200. For example, the recessed portion 402 may taper from the lateral edge 411 toward the medial edge 413. The recessed portion 402 has a first, anterior axis $A_A$ and a second, posterior axis $A_P$, each extending between the lateral side 410 and the medial side 412 of the cushioning member 130. The first axis $A_A$ and the second axis $A_P$ are angled, such that the first axis $A_A$ and the second axis $A_P$ define a convergent path from the lateral side 410 toward the medial side 412. Thus, the recessed portion 402 has an asymmetrical shape similar to the asymmetric shape of the bladder 200. Namely, the recessed portion 402 of the cushioning member 130 is asymmetric about an axis extending through the center of the recessed portion 402 from the lateral edge 411 to the medial edge 413 and is asymmetric about an axis extending through the center of the recessed portion 402 from an anterior edge 424 to a posterior edge 426.

As described above, the cushioning member 130 is formed of a resilient polymeric material, such as foam or rubber, to impart properties of cushioning, responsiveness, and energy distribution to the foot of the wearer. Example resilient polymeric materials for the cushioning member 130 may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some instances, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further examples, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further examples, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further examples, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further examples, the one or more polymers may include one or more polyamide copolymers (e.g., polyamide-polyether copolymers) and/or one or more polyurethanes (e.g., crosslinked polyurethanes and/or thermoplastic polyurethanes). Examples of suitable polyurethanes include those discussed above for barrier elements 202, 204. Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as adodicarbonamide, sodium bicarbonate, and/or an isocyanate.

In some instances, the foamed polymeric material may be a crosslinked foamed material. In these examples, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a crosslinking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened, and the molded foam article is removed from the mold.

As mentioned above, the outsole 128 (see, e.g., FIGS. 1 and 4) is the primary ground-engaging surface of the footwear 100. Although shown schematically as a relatively smooth surface for purposes of illustration, the outsole 128 can include various traction-enhancing elements. For example, an outsole can include grooves, lugs, ribs, spikes, cleats, etc. The outsole 128 can, in some instances, be relatively uniform across the footwear. In other instances, the outsole 128 can comprise various segments with different materials and/or traction-enhancing elements. In addition to being disposed on the inferior surface of the footwear 100, in some examples, the outsole 128 can be disposed on one or more other surfaces. For example, an outsole 128 can comprise a toe cap and/or a heel cap configured to protect ends of the footwear 100.

The outsole 128 can be formed of resilient materials that impart properties of abrasion resistance and traction to the sole structure 104. One or more of the outsole segments may be formed of a first material having a higher durometer than the others of the outsole segments. For example, one segment may be formed of a rubber material having a first durometer, while another segment is formed of a foam material having a second durometer, less than the first durometer. Further, and as shown in FIGS. 3 and 4, the outsole 128 may be a plate and, as such, may be formed from a relatively rigid material.

The outsole 128 has a first surface 500 that defines a receiving region 502 and an opposing second surface 504, described below. The receiving region 502 is defined within the forefoot region 106 (FIG. 2) of the sole structure 104 and is configured to receive the bladder 200. The receiving region 502 includes a first protrusion 506 defined by a first segment 508 and a second segment 510 and also includes a second protrusion 512 disposed on an opposite side of the outsole 128 than the first protrusion 506 (FIG. 3). The first protrusion 506 extends from the first surface 500 to define a depression in the second surface 504 of the outsole 128 along a lateral side 514 of the outsole 128. The second protrusion 512 extends from the first surface 500 along a medial side 516 of the outsole 128. The second protrusion extends along the medial side 516 in a direction between an anterior end 518 and a posterior end 520 of the outsole 128. The second protrusion 512 may have a substantially arcuate configuration to match or be substantially similar to the medial edge 217 of the bladder 200.

As mentioned above, the first protrusion 506 includes a first segment 508 and a second segment 510 connected to one another by an arcuate segment 522 located at a terminal end 524 of the first protrusion 506. As shown in FIG. 3, the segments 508, 510 of the first protrusion 506 transition into a first segment 526 and a second segment 528 of the outsole 128 at a radius 530. The segments 526, 528 are defined along the lateral side 514 of the outsole 128 and cooperate to define an opening of the first protrusion 506.

As described above with respect to the notch 214 and the projection 406, the first protrusion 506 may be aligned with the ball portion **106*b* of a wearer's foot (e.g., in the metatarsal head region) and can, for example, allow the cushioning member 130 to articulate (e.g., flex, pivot, etc.) with the wearer's foot. In particular instances, the first protrusion 506 may be aligned with (e.g., at least partially longitudinally overlap) the first metatarsal head of the wearer's foot. In other instances, the first protrusion 506 may be aligned with the second metatarsal head of the wearer's foot. In other instances, the first protrusion 506 may be aligned with the third metatarsal head of the wearer's foot. In other instances, the first protrusion 506 may be aligned with the fourth metatarsal head of the wearer's foot. In other instances, the first protrusion 506** may be aligned with the fifth metatarsal head of the wearer's foot.

In some examples, as similarly described with respect to the notch 214 and the projection 406, the first protrusion 506 may include a substantially uniform width. In such examples, the first protrusion 506 includes a first width $W_1$ adjacent to a lateral edge 515 of the outsole 128 and a second width $W_2$ proximate to the terminal end 524 of the first protrusion 506. In this configuration, the widths $W_1$, $W_2$ are approximately equal to one another such that the first width $W_1$ and the second width $W_2$ are within 3% of one another. In this manner, the first protrusion 506 comprises a substantially "U" shape. In other examples, the first protrusion 506 may include a non-uniform width. In such examples, the first width $W_1$ and the second width $W_2$ differ by more than 3%, as shown in FIG. 4. In these cases, the first protrusion 506 comprises a substantially "V" or "tapered" shape. When the first protrusion 506 is tapered, the first protrusion 506 tapers in a direction from the lateral edge 515 toward the terminal end 524 such that the first protrusion 506 decreases in width from the lateral edge 515 to the terminal end 524 (i.e., in a direction from the lateral edge 515 toward a medial edge 517). Such tapering can be constant, as shown in FIG. 4, or can vary along a length L of the first protrusion 506 from the lateral edge 515 to the terminal end 524. In other instances, the first protrusion 506 can comprise various other shapes and/or widths.

The first protrusion comprises a length L defined as a straight-line distance from the lateral edge 515 to the terminal end 524. In some examples, the length L of the first protrusion 506 can be less than 50% of a max width of the receiving portion 402 (FIG. 4). In some examples, the length L of the first protrusion 506 can be less than 40% of the max width of the receiving region 502. In some examples, the length L of the first protrusion 506 can be less than 30% of the max width of the receiving region 502. In some examples, the length L of the first protrusion 506 can be less than 20% of the max width of the receiving region 502. In particular examples, the length L of the first protrusion 506 can be within a range of 10-50% of the max width of the receiving region 502. In certain examples, the length L of the first protrusion 506 can be within a range of 20-40% of the max width of the receiving region 502.

The outsole 128 may also include traction elements 540 coupled to the second surface 504. The traction elements 540 may be connected to the outsole 128 at attachment locations 542 defined along the second surface 504. The second surface 504 may also define an aperture 544 configured to align with the second recessed portion 402*a* defined in the midfoot region 108.

In some examples, the traction elements 540 may include a first traction element 540 and a second traction element 540 disposed proximate to the first segment 526 and the second segment 528. For example, the first traction element 540 and the second traction element 540 may be disposed on opposing sides of the first protrusion 506 along the second surface 504. The first protrusion 506 defines a channel between the segments 508, 510, which may provide additional flexion for the sole structure 104. The traction elements 540 are configured to provide traction and grip for the footwear (e.g., the traction elements 540 engaging with a ground surface). Thus, the separation of the segments 508, 510 of the first protrusion 506 advantageously provides the footwear with the freedom to engage some of the traction elements 540 while releasing the other traction elements 540.

For example, the traction elements 540 in the forefoot region 106 may be engaged by the wearer's foot while the traction elements 540 in the midfoot and heel regions 108, 110 may be released. The channel defined by the first protrusion 506 provides the outsole 128 with additional flexion capability, and the combination with the notch 214 of the bladder 200 and the projection 406 of the cushioning member 130 provides the wearer with flexibility and supportive stability for the footwear 100. FIG. 19 illustrates the cooperative nesting of the projection 406 and the first protrusion 506 with the notch 214 of the bladder 200. For example, the projection 406 and the first protrusion 506 are depicted as extending into the notch 214. In some instances, the projection 406 and the first protrusion 506 are free from contact (e.g., a space or gap is defined within the notch 214 between the first protrusion 506 and the projection 406). In other examples, the projection 406 may be compressed into the notch 214 by a wearer's foot to make at least partial contact with the first protrusion 506.

In the foregoing examples, the bladders 200, 200*a*, 300 serve to provide the article of footwear 100 with support and cushioning properties. The bladders 200, 200*a*, 300 may include a notch 214 or a depression 214 to facilitate bending of the bladders 200, 200*a*, 300 during use. Further, the bladders 200, 200*a*, 300 include a jogged peripheral seam 208-208*f* that provides the bladders 200, 200*a*, 300 with stability and improved aesthetics simultaneously. The bladders 200, 200*a*, 300 in combination with the other components of the midsole 126 and the outsole 128 provide the article of footwear 100 with cushioning and responsiveness during wear.

The following Clauses provide an exemplary configuration for a bladder for an article of footwear described above.

Clause 1. A sole structure for an article of footwear, the sole structure including a cushioning member including a recessed portion and a projection, an outsole coupled to the cushioning member and including a protrusion, and a bladder disposed between the cushioning member and the outsole, the bladder including a first segment and a second segment and defining a notch between the first segment and the second segment, the notch extending from a first edge of the bladder in a direction toward a second edge of the bladder, the projection of the cushioning member and the protrusion of the outsole least partially disposed within the notch of the bladder.

Clause 2. The sole structure of Clause 1, wherein the notch may include a terminal end and an opening at the first edge, the notch tapering from a direction from the first edge toward the terminal end.

Clause 3. The sole structure of Clause 2, wherein the first segment and the second segment each include a radius that further defines the opening of the notch, the opening defining a widest point of the notch.

Clause 4. The sole structure of Clause 1, wherein the bladder includes a first arcuate segment and a second arcuate segment each connected to a third edge of the bladder, the third edge connected to the first edge of the bladder by the first arcuate segment and connected to the second edge of the bladder by the second arcuate segment.

Clause 5. The sole structure of Clause 4, wherein the bladder includes a planar portion connecting the first arcuate segment and the second arcuate segment.

Clause 6. The sole structure of Clause 1, wherein the bladder defines an asymmetric shape about an axis extending through a center of the bladder and the recessed portion of the cushioning member defines an asymmetric shape about an axis extending through a center of the recessed portion.

Clause 7. The sole structure of Clause 1, wherein the first segment and the second segment each include a substantially straight portion extending along a respective axis, the axis of the first segment convergent with the axis of the second segment.

Clause 8. The sole structure of Clause 1, wherein the bladder includes a third segment and a fourth segment, the third segment defined between the notch and a third edge of the bladder and the fourth segment defined between the notch and a fourth edge of the bladder.

Clause 9. The sole structure of Clause 8, wherein the fourth segment has a length greater than a length of the third segment.

Clause 10. An article of footwear including the sole structure of Clause 1.

Clause 11. A sole structure for an article of footwear, the sole structure including a cushioning member including a recessed portion and a projection, an outsole coupled to the cushioning member and including a protrusion, and a bladder disposed between the cushioning member and the outsole, the bladder including a first segment and a second segment and defining a notch between the first segment and the second segment, the projection of the cushioning member and the protrusion of the outsole at least partially disposed within the notch of the bladder, the bladder being asymmetric about an axis extending through the center of the bladder.

Clause 12. The sole structure of Clause 11, the notch extends from a first edge of the bladder toward a second edge of the bladder and includes a terminal end and an opening at a first edge, the notch tapering from a direction from the first edge toward the terminal end.

Clause 13. The sole structure of Clause 12, wherein the first segment and the second segment each include a radius that further defines the opening of the notch, the opening defining a widest point of the notch.

Clause 14. The sole structure of Clause 12, wherein the bladder includes a first arcuate segment and a second arcuate segment each connected to a third edge of the bladder, the third edge connected to the first edge of the bladder by the first arcuate segment and connected to the second edge of the bladder by the second arcuate segment.

Clause 15. The sole structure of Clause 14, wherein the bladder includes a planar portion connecting the first arcuate segment and the second arcuate segment.

Clause 16. The sole structure of Clause 11, wherein the bladder defines an asymmetric shape about an axis extending through a center of the bladder and the recessed portion of the cushioning member defines an asymmetric shape about an axis extending through a center of the recessed portion.

Clause 17. The sole structure of Clause 11, wherein the first segment and the second segment each include a substantially straight portion extending along a respective axis, the axis of the first segment convergent with the axis of the second segment.

Clause 18. The sole structure of Clause 12, wherein the bladder includes a third segment and a fourth segment, the third segment defined between the notch and a third edge of the bladder and the fourth segment defined between the notch and a fourth edge of the bladder.

Clause 19. The sole structure of Clause 18, wherein the fourth segment has a length greater than a length of the third segment.

Clause 20. An article of footwear including the sole structure of Clause 11.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear, the sole structure comprising:

a cushioning member including a recessed portion and a projection;

a bladder disposed within the recessed portion and including a bladder notch extending from a first edge of the bladder on a lateral side of the sole structure in a direction toward a second edge of the bladder on a medial side of the sole structure, the projection of the cushioning member at least partially disposed within the bladder notch; and an outsole attached to the bladder on an opposite side from the cushioning member and including an outsole notch aligned with the bladder notch and an outsole protrusion surrounding the outsole notch and at least partially received within the bladder notch.

2. The sole structure of claim 1, wherein the bladder notch includes a terminal end and an opening at the first edge, the bladder notch tapering in a direction from the first edge toward the terminal end.

3. The sole structure of claim 2, wherein the bladder notch is defined between a first segment of the bladder and a second segment of the bladder each including a radius that further defines the opening of the bladder notch, the opening defining a widest point of the notch.

4. The sole structure of claim 1, wherein the bladder includes a first arcuate segment and a second arcuate segment each connected to a third edge of the bladder, the third edge connected to the first edge of the bladder by the first arcuate segment and connected to the second edge of the bladder by the second arcuate segment.

5. The sole structure of claim 4, wherein the third edge of the bladder includes a planar portion connecting the first arcuate segment and the second arcuate segment.

6. The sole structure of claim 1, wherein the bladder defines an asymmetric shape about an axis extending through a center of the bladder and the recessed portion of the cushioning member defines an asymmetric shape about an axis extending through a center of the recessed portion.

7. The sole structure of claim 3, wherein the first segment and the second segment each includes a substantially straight portion extending along a respective axis, the axis of the first segment convergent with the axis of the second segment.

8. The sole structure of claim 7, wherein the first segment has a length greater than a length of the second segment.

9. An article of footwear including the sole structure of claim 1.

10. A sole structure for an article of footwear, the sole structure comprising:

a cushioning member including a recessed portion and a projection;

a bladder disposed within the recessed portion and including a first segment and a second segment and defining a bladder notch between the first segment and the second segment, the projection of the cushioning member at least partially disposed within the bladder notch, the bladder being asymmetric about an axis extending through the center of the bladder; and an outsole attached to the bladder on an opposite side from the cushioning member and including an outsole protrusion at least partially received within the bladder notch and an outsole notch formed within the outsole protrusion and aligned with the bladder notch.

11. The sole structure of claim 10, wherein the bladder notch extends from a first edge of the bladder toward a second edge of the bladder and includes a terminal end and an opening at the first edge, the bladder notch tapering in a direction from the first edge toward the terminal end.

12. The sole structure of claim 11, wherein the first segment and the second segment each includes a radius that further defines the opening of the notch, the opening defining a widest point of the notch.

13. The sole structure of claim 11, wherein the bladder includes a first arcuate segment and a second arcuate segment each connected to a third edge of the bladder, the third edge connected to the first edge of the bladder by the first arcuate segment and connected to the second edge of the bladder by the second arcuate segment.

14. The sole structure of claim 13, wherein the third edge of the bladder includes a planar portion connecting the first arcuate segment and the second arcuate segment.

15. The sole structure of claim 10, wherein the recessed portion of the cushioning member defines an asymmetric shape about an axis extending through a center of the recessed portion.

16. The sole structure of claim 10, wherein the first segment and the second segment each includes a substantially straight portion extending along a respective axis, the axis of the first segment convergent with the axis of the second segment.

17. The sole structure of claim 16, wherein the first segment has a length greater than a length of the second segment.

18. An article of footwear including the sole structure of claim 10.

* * * * *